US011493278B2

(12) United States Patent
Sato

(10) Patent No.: US 11,493,278 B2
(45) Date of Patent: Nov. 8, 2022

(54) EVAPORATOR AND COOLING SYSTEM

(71) Applicant: FUJITSU LIMITED, Kawasaki (JP)

(72) Inventor: Yoichi Sato, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 245 days.

(21) Appl. No.: 16/674,027

(22) Filed: Nov. 5, 2019

(65) Prior Publication Data

US 2020/0166287 A1 May 28, 2020

(30) Foreign Application Priority Data

Nov. 27, 2018 (JP) ..... JP2018-221701

(51) Int. Cl.
*F28D 15/02* (2006.01)

(52) U.S. Cl.
CPC ..... *F28D 15/025* (2013.01); *F28D 15/0266* (2013.01)

(58) Field of Classification Search
CPC . H01L 23/427; F28D 15/043; F28D 15/0283; F28D 15/025; F28D 15/0266; F28D 15/02; F28D 15/0275; F28D 1/06; H05K 7/20
See application file for complete search history.

(56) References Cited

U.S. PATENT DOCUMENTS 5,351,488 A * 10/1994 Sorensen ..... F03G 6/003 60/641.11
2005/0061487 A1* 3/2005 Kroliczek ..... F28D 15/043 165/139
2009/0071631 A1* 3/2009 Ippoushi ..... F24T 10/40 165/104.24

FOREIGN PATENT DOCUMENTS

JP 2006-012875 1/2006
JP 2008-28122 A 2/2008
JP 2008-311399 A 12/2008

OTHER PUBLICATIONS

Japanese Office Action dated May 31, 2022 for corresponding Japanese Patent Application No. 2018-221701, with English Translation, 11 pages.

* cited by examiner

*Primary Examiner* — Harry E Arant
(74) *Attorney, Agent, or Firm* — Fujitsu Patent Center

(57) ABSTRACT

An evaporator includes: a container; a first supplying unit configured to supply a liquid phase refrigerant to an inside of the container; a second supplying unit configured to supply the liquid phase refrigerant along a surface of the container; a heat absorbing unit configured to be disposed on the inside, and in which the liquid phase refrigerant supplied to the inside by the first supplying unit absorbs heat supplied from an outside of the container; a storage part configured to be disposed on the inside, stores the liquid phase refrigerant absorbing the heat in the heat absorbing unit, and stores the liquid phase refrigerant obtained by cooling and condensing a gaseous phase refrigerant evaporated by heat absorption in the heat absorbing unit by using the liquid phase refrigerant supplied along the surface by the second supplying unit; and a discharging unit configured to discharge the liquid phase refrigerant stored.

9 Claims, 20 Drawing Sheets

EVAPORATOR AND COOLING SYSTEM

CROSS-REFERENCE TO RELATED APPLICATION

This application is based upon and claims the benefit of priority of the prior Japanese Patent Application No. 2018-221701, filed on Nov. 27, 2018, the entire contents of which are incorporated herein by reference.

FIELD

The embodiments discussed herein relate to an evaporator and a cooling system.

BACKGROUND

In relation to a technology of cooling an electronic device that generates heat as the electronic device operates, a cooling device, for example, is known in which an evaporator cooling a semiconductor element, a condenser, and a liquid pump are sequentially coupled to a closed circuit by pipes. Further, a method is proposed which partially radiates the heat of a refrigerant heated into a gas-liquid mixed state within an evaporator by an auxiliary condenser or a radiator installed on the evaporator, thereafter condenses and liquefies the refrigerant by a condenser, and feeds the refrigerant to the evaporator again by a liquid pump.

Examples of the related art include Japanese Laid-open Patent Publication No. 2006-12875.

SUMMARY

According to an aspect of the embodiment, an evaporator includes: a container; a first supplying unit configured to supply a liquid phase refrigerant to an inside of the container; a second supplying unit configured to supply the liquid phase refrigerant along a surface of the container; a heat absorbing unit configured to be disposed on the inside, and in which the liquid phase refrigerant supplied to the inside by the first supplying unit absorbs heat supplied from an outside of the container; a storage part configured to be disposed on the inside, stores the liquid phase refrigerant absorbing the heat in the heat absorbing unit, and stores the liquid phase refrigerant obtained by cooling and condensing a gaseous phase refrigerant evaporated by heat absorption in the heat absorbing unit by using the liquid phase refrigerant supplied along the surface by the second supplying unit; and a discharging unit configured to discharge the liquid phase refrigerant stored in the storage part.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

In a cooling system in which a liquid phase refrigerant is filled in a decompressed state into a closed circuit formed by coupling an evaporator, a radiator, and a pump, and cooling is performed by utilizing a vaporization phenomenon (may be referred to as "vaporizing phenomenon", "boiling phenomenon", "evaporating phenomenon", "evaporation phenomenon", and the like) of the liquid phase refrigerant heated in the evaporator, the cooling capacity of the evaporator is enhanced when a condition (quantity of the refrigerant, internal pressure, or the like) is used under which vaporizing (may be referred to as "vaporization", "evaporation", "evaporating", "boiling", and the like) occurs easily in the evaporator.

However, when a gaseous phase refrigerant discharged from the evaporator due to vaporizing is increased, the gaseous phase refrigerant present within the closed circuit of the cooling system is increased, the gaseous phase refrigerant is easily taken into the pump, and there is thus a fear that stable refrigerant circulation may not be performed by the pump.

In one aspect, it is an object of the embodiments discussed herein to realize a high cooling capacity while suppressing discharging of the gaseous phase refrigerant from the evaporator.

An example of the cooling system will first be described.

Figure 1A:
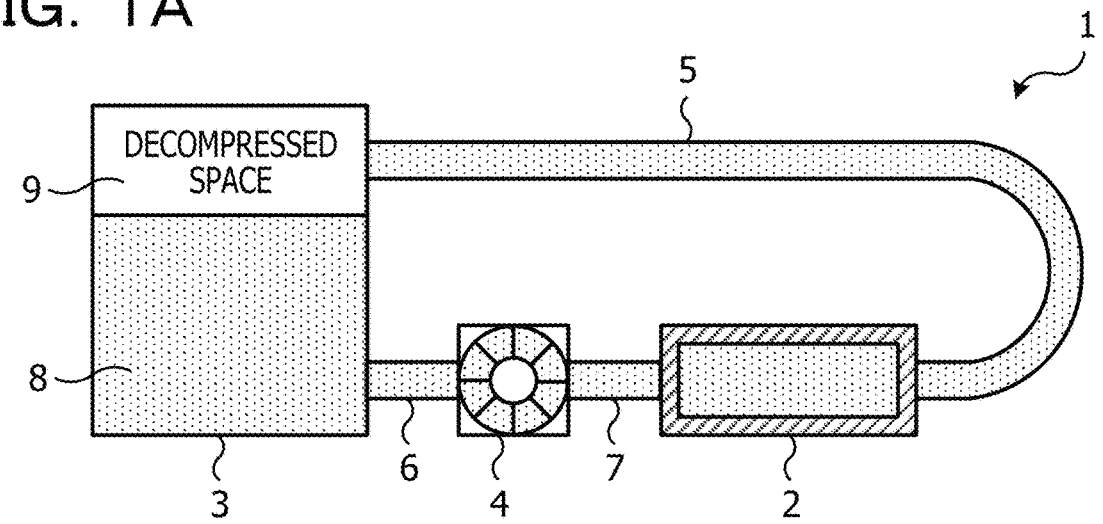
FIGS. 1A, 1B, and 1C are diagrams of assistance in explaining an example of a cooling system.
Figure 1B:
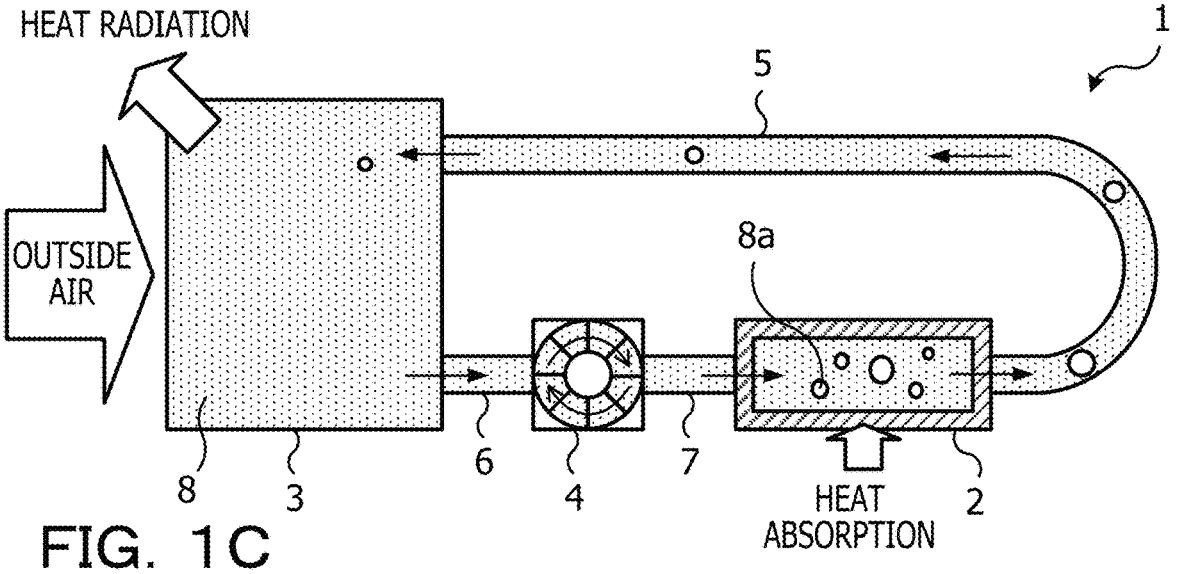
Figure 1C:
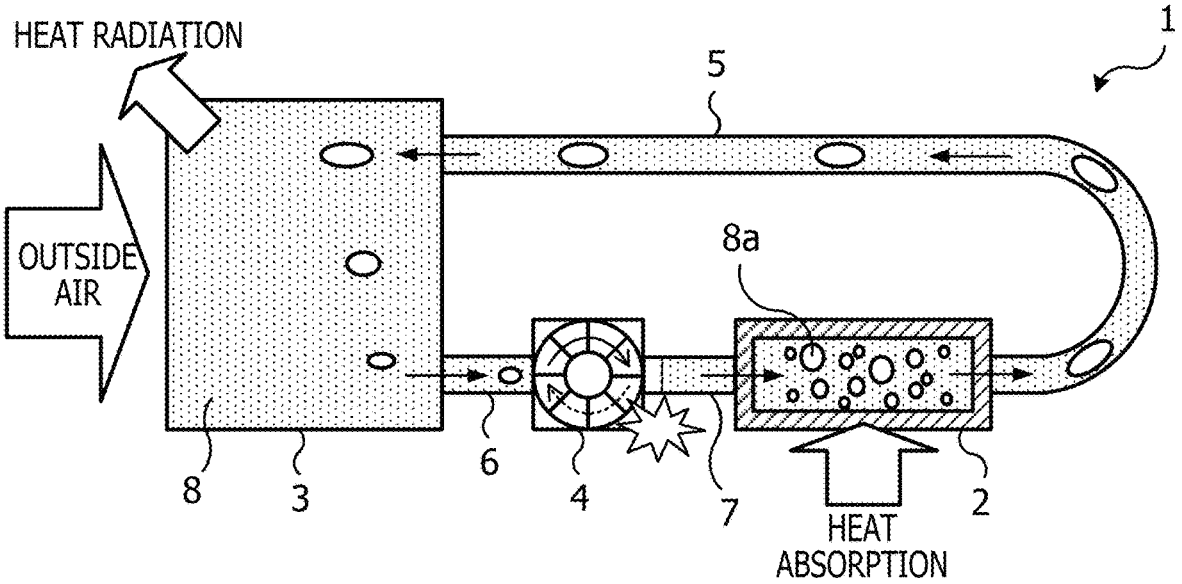

FIGS. 1A, 1B, and 1C are diagrams of assistance in explaining an example of the cooling system. FIG. 1A schematically illustrates an example of the cooling system. FIG. 1B schematically illustrates an example of a state during operation of the cooling system. FIG. 1C schematically illustrates an example of a problem occurring during the operation of the cooling system.

As illustrated in FIG. 1A, the cooling system 1 includes an evaporator 2, a radiator 3, and a pump 4. The evaporator 2 and the radiator 3 are coupled to each other by a pipe 5. The radiator 3 and the pump 4 are coupled to each other by a pipe 6. The pump 4 and the evaporator 2 are coupled to each other by a pipe 7. The evaporator 2, the radiator 3 and the pump 4 as well as the pipe 5, the pipe 6, and the pipe 7 form a closed circuit of the cooling system 1. A liquid phase refrigerant 8 is filled in a decompressed state into the closed circuit of such a cooling system 1. FIG. 1A illustrates an example in which there is a decompressed space 9 within the radiator 3 before the operation of the cooling system 1 or in a case where an amount of heat absorbed in the evaporator 2 is small during operation as described later, for example.

The cooling system 1 will be further described with reference to FIG. 18. In the cooling system 1, utilizing the vaporizing phenomenon (may be referred to as "boiling phenomenon", "evaporating phenomenon", "evaporation phenomenon", "vaporization phenomenon", and the like) of the internal liquid phase refrigerant 8, the evaporator 2 absorbs heat transmitted from an external heat generating body to be cooled by the cooling system 1, for example, heat generated from an electronic device as the electronic device operates. The evaporator 2 thereby cools the external heat generating body such as the electronic device or the like. The radiator 3 takes in the liquid phase refrigerant 8 including a gaseous phase refrigerant 8*a*, the liquid phase refrigerant 8 being increased in temperature by absorbing heat in the evaporator 2, through the pipe 5, and radiates the heat to the outside. The radiator 3 thereby condenses the gaseous phase refrigerant 8*a* and lowers the temperature of the liquid phase refrigerant 8. The pump 4 takes in the liquid phase refrigerant 8 condensed and lowered in temperature by the radiator 3 through the pipe 6, and feeds the liquid phase refrigerant 8 to the evaporator 2 through the pipe 7. Using the liquid phase refrigerant 8 fed from the pump 4 through the pipe 7, the evaporator 2 absorbs heat from the external heat generating body such as the electronic device or the like (cools the external heat generating body). The cooling system 1 is an example of a gas-liquid two-phase flow forced circulation type cooling system that thus utilizes the vaporization phenomenon of the liquid phase refrigerant 8. Incidentally, the evaporator 2 may be referred to as a receiver, a cooler, or the like. In addition, the radiator 3 may be referred to as a condenser or the like.

In the cooling system 1 as described above, the cooling capacity of the evaporator 2 is enhanced when a condition is used under which boiling (may be referred to as "evaporation", "vaporization", and the like) of the liquid phase refrigerant 8 occur easily in the evaporator 2, that is, when a condition is used under which the gaseous phase refrigerant 8*a* occurs easily due to the boiling of the liquid phase refrigerant 8. FIG. 1C illustrates an example of the cooling system 1 in a case where a condition under which boiling of such a liquid phase refrigerant 8 occurs easily is used. The more easily the liquid phase refrigerant 8 boils, the more easily a phase change from the liquid phase refrigerant 8 to the gaseous phase refrigerant 8*a* due to heat occurs. Therefore, heat absorption from the external heat generating body is promoted, and efficiency of heat transmission to the evaporator 2 is enhanced. The external heat generating body is thereby cooled efficiently, so that the cooling capacity of the evaporator 2 is enhanced. In a case where boiling of the liquid phase refrigerant 8 is made to occur easily in the cooling system 1, the filling rate of the liquid phase refrigerant 8, internal pressure, and the like within the closed circuit are adjusted.

However, when a condition under which the liquid phase refrigerant 8 boils easily in the evaporator 2 is used, and consequently the amount of generation of the gaseous phase refrigerant 8*a* in the evaporator 2 is increased and the amount of discharge of the gaseous phase refrigerant 8*a* from the evaporator 2 is thereby increased, the gaseous phase refrigerant 8*a* present within the closed circuit of the cooling system 1 is increased. As a result, the gaseous phase refrigerant 8*a* discharged from the evaporator 2 and fed to the radiator 3 is not sufficiently condensed in the radiator 3, and the gaseous phase refrigerant 8*a* remaining without being condensed is more likely to be sucked into the pump 4. In addition, even when the gaseous phase refrigerant 8*a* is condensed by the radiator 3 and becomes the liquid phase refrigerant 8, reboiling (cavitation) due to decompression on the sucking-in side of the pump 4 may occur depending on a balance with the flow rate of the pump 4, and the resulting gaseous phase refrigerant 8*a* may be sucked into the pump 4. FIG. 1C schematically illustrates conditions in which such problems occur. When the gaseous phase refrigerant 8*a* generated in the evaporator 2 and discharged from the evaporator 2 is sucked into the pump 4, and so-called biting of the pump 4 occurs, the feeding of the liquid phase refrigerant 8 from the pump 4 to the evaporator 2 is delayed. As a result, heating is continued in a state with a smaller amount of liquid phase refrigerant 8. Thus, problems occur in that the function of the evaporator 2 is degraded, the gaseous phase refrigerant 8*a* discharged after being generated in the evaporator 2 is further increased, and the biting of the gaseous phase refrigerant 8*a* by the pump 4 occurs more easily.

Thus, depending on the configuration of the cooling system 1, when the condition under which the boiling of the liquid phase refrigerant 8 occurs easily is used to enhance the cooling capacity of the evaporator 2, there is a fear of being unable to perform stable circulation of the liquid phase refrigerant 8 by the pump 4. There is consequently a fear of causing a degradation in the function of the evaporator 2, and inviting overheating of the external heat generating body such as an electronic device or the like, and further inviting damage and performance degradation in the external heat generating body due to the overheating, because the external heat generating body is not cooled sufficiently.

In order to perform stable circulation of the liquid phase refrigerant 8 by the pump 4 in the cooling system 1, a condition is used under which the amount of discharge of the gaseous phase refrigerant 8*a* from the evaporator 2 is reduced by reducing the amount of generation of the gaseous phase refrigerant 8*a* in the evaporator 2, or a condition is used under which a state as in FIG. 1B, for example, is obtained. However, under such a condition, the generation of the gaseous phase refrigerant 8*a* in the evaporator 2 is suppressed. Therefore, an amount of heat absorbed in the evaporator 2 may be decreased, and a sufficient cooling capacity of the evaporator 2 may not be obtained. One electronic device as an example of the heat generating body to be cooled by the cooling system 1 is, for example, a processor. Amounts of heat generation of recent processors are increasing as the performance of the processors is enhanced, and the heat generation density of the recent processors is coming close to being comparable to a fuel rod surface temperature in a nuclear reactor. When the cooling capacity of the evaporator 2 is not sufficient in a case where the cooling system 1 is applied to such a processor, there is an increasing possibility of inviting overheating of the processor, and further inviting damage and performance degradation in the processor due to the overheating.

As described above, in the cooling system 1, when the amount of generation of the gaseous phase refrigerant 8*a* in the evaporator 2 is increased to enhance the cooling capacity of the evaporator 2, the amount of discharge of the gaseous phase refrigerant 8*a* from the evaporator 2 is increased, and stable circulation of the liquid phase refrigerant 8 by the pump 4 may not be performed (FIG. 1C). On the other hand, in the cooling system 1, when the amount of generation of the gaseous phase refrigerant 8*a* in the evaporator 2 is reduced to perform stable circulation of the liquid phase refrigerant 8 by the pump 4, a sufficient cooling capacity of the evaporator 2 may not be obtained (FIG. 1B).

In view of the points as described above, reducing the amount of discharge of the gaseous phase refrigerant from the evaporator while increasing the amount of generation of the gaseous phase refrigerant in the evaporator in the cooling system is considered to be effective in realizing stable pump circulation while realizing a high cooling capacity of the evaporator. The following description will be made of an evaporator enabling this and a cooling system including such an evaporator or the like as embodiments. Incidentally, in the following description, a gravitational direction G will be "downward," and a direction opposite from the gravitational direction G will be "upward."

First Embodiment

Figure 2:
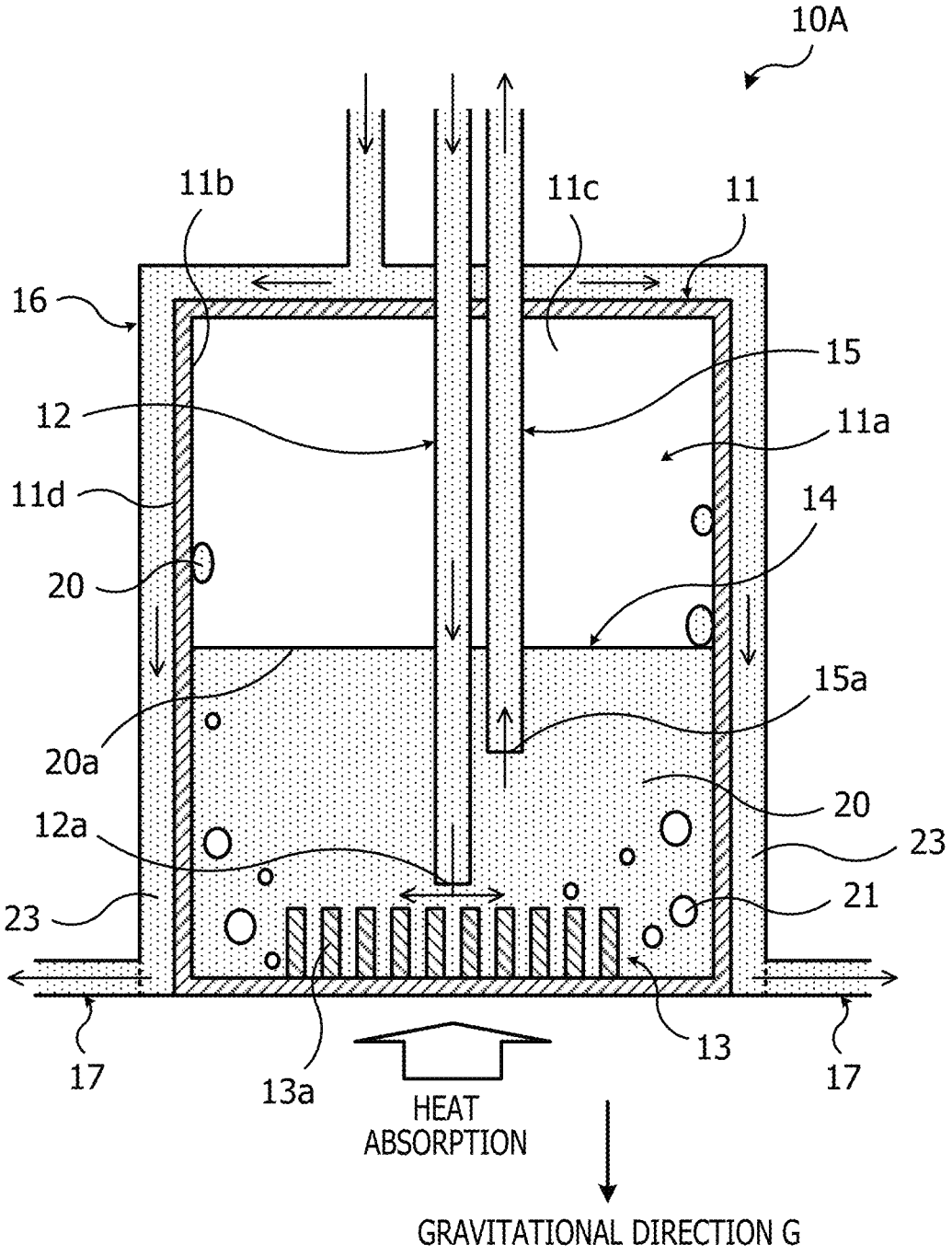
FIG. 2 is a diagram of assistance in explaining a first example of an evaporator according to a first embodiment.

FIG. 2 is a diagram of assistance in explaining a first example of an evaporator according to a first embodiment. FIG. 2 schematically illustrates a fragmentary sectional view of the example of the evaporator.

An evaporator 10A illustrated in FIG. 2 includes a container 11, a supplying unit 12 that supplies a liquid phase refrigerant 20 into the container 11, a heat absorbing unit 13 in which the liquid phase refrigerant 20 within the container 11 absorbs heat from the outside, a storage part 14 that stores the liquid phase refrigerant 20, and a discharging unit 15 that discharges the liquid phase refrigerant 20 within the container 11. The evaporator 10A further includes a supplying unit 16 that supplies the liquid phase refrigerant 20 along the surface of the container 11 and a discharging unit 17 that discharges the liquid phase refrigerant 20.

The container 11 has, in an inner part 11*a*, a space that may store a certain amount of liquid phase refrigerant 20 and a gaseous phase refrigerant 21 generated by boiling (may be referred to as "evaporation", "vaporization", and the like) of the liquid phase refrigerant 20. The container 11 may be formed by a plurality of members such as a box-shaped main body and a lid covering the box-shaped main body or a bottom plate and a box-shaped main body covering the bottom plate as long as the container 11 thus has a certain space in the inner part 11*a* and may store the liquid phase refrigerant 20 and the like. Here, a container 11 of a rectangular parallelepiped type is illustrated as an example. However, the shape of the container 11 is not limited to this, and it is possible to use containers 11 in various kinds of shapes such as a dome shape, a hanging bell shape, a drum shape, a hand drum shape, a sphere shape, and the like. A material excellent in thermal conductivity is used for the container 11. For example, metallic materials and alloy materials such as copper, aluminum, brass, stainless steel, and the like are used for the container 11. In addition, carbon materials such as graphite and the like or ceramic materials such as aluminum nitride, silicon carbide, and the like may be used for the container 11.

The supplying unit 12 supplies the liquid phase refrigerant 20 to the inner part 11*a* of the container 11. The supplying unit 12 is, for example, coupled to a pump coupled to a radiator of a cooling system in which the evaporator 10A is used. The liquid phase refrigerant 20 having a relatively low temperature, the liquid phase refrigerant 20 being condensed by the radiator and fed by the pump, is guided to the supplying unit 12. The supplying unit 12 supplies the liquid phase refrigerant 20 to the inner part 11*a* of the container 11. For example, the liquid phase refrigerant 20 fed by the pump is branched, and a part of the branched liquid phase refrigerant 20 is guided to the supplying unit 12 and supplied to the inner part 11*a* of the container 11. A pipe extending from an upper portion to a lower portion of the container 11, for example, is used as the supplying unit 12. The supplying unit 12 is disposed such that an outlet 12*a* of the supplying unit 12 reaches the heat absorbing unit 13 or is located in the vicinity of the heat absorbing unit 13.

The heat absorbing unit 13 is a part where the liquid phase refrigerant 20 supplied to the inner part 11*a* of the container 11 by the supplying unit 12 mainly absorbs heat from the outside (or receives heat or is heated). For example, the heat absorbing unit 13 is thermally coupled directly or indirectly to the external heat generating body such as an electronic device or the like to be cooled by the evaporator 10A, and in the heat absorbing unit 13, heat generated from the heat generating body is absorbed by the liquid phase refrigerant 20 supplied to the inner part 11*a* of the container 11. The heat absorbing unit 13 is provided so as to be located in a lower portion of the container 11 illustrated in FIG. 2, that is, a lower layer portion of the liquid phase refrigerant 20 stored in the inner part 11*a* of the container 11. The heat absorbing unit 13 may be formed, for example, by a plurality of fins 13*a* protruding from an inner surface 11*b* to the inner part 11*a* of the container 11.

The storage part 14 is a part that stores (or collects) the liquid phase refrigerant 20 absorbing heat in the heat absorbing unit 13 and the liquid phase refrigerant 20 cooled and condensed after absorbing heat and evaporating in the heat absorbing unit 13. A certain amount of liquid phase refrigerant 20 is stored in the storage part 14. The liquid phase refrigerant 20 stored in the storage part 14 may include a gaseous phase refrigerant 21 generated by heat absorption in the heat absorbing unit 13. In the inner part 11*a* of the container 11 illustrated in FIG. 2, a space 11*c* that includes the gaseous phase refrigerant 21 generated from the liquid phase refrigerant 20 absorbing heat or which is a vacuum space is present above a liquid surface 20*a* of the liquid phase refrigerant 20 stored in the storage part 14. The volume of this space is set based on the amount of the liquid phase refrigerant 20 and pressure at a time of filling the liquid phase refrigerant 20 in a decompressed state into the closed circuit (sealed space) of the cooling system in which the evaporator 10A is used. The storage part 14 stores a certain amount of liquid phase refrigerant 20 such that the space 11*c* having the set volume remains in the inner part 11*a* of the container 11.

The discharging unit 15 discharges the liquid phase refrigerant 20 stored in the storage part 14 or the liquid phase refrigerant 20 including the gaseous phase refrigerant 21 from the inner part 11*a* of the container 11 to the outside. The discharging unit 15 is, for example, coupled to the radiator of the cooling system in which the evaporator 10A is used. The liquid phase refrigerant 20 raised to a relatively high temperature in the evaporator 10A or the liquid phase refrigerant 20 including the gaseous phase refrigerant 21 is discharged through the discharging unit 15, and fed to the radiator. A pipe extending from the upper portion of the container 11 into the liquid phase refrigerant 20 in the storage part 14 is, for example, used as the discharging unit 15. The discharging unit 15 is disposed such that an inlet 15*a* of the discharging unit 15 is located below the liquid surface 20*a* of the liquid phase refrigerant 20.

The supplying unit 16 supplies the liquid phase refrigerant 20 along an outer surface 11*d* (surface) of the container 11. The supplying unit 16 is, for example, coupled to the pump coupled to the radiator of the cooling system in which the evaporator 10A is used. The liquid phase refrigerant 20 at a relatively low temperature, the liquid phase refrigerant 20 being condensed by the radiator and fed by the pump, is guided to the supplying unit 16. The supplying unit 16 supplies the liquid phase refrigerant 20 along the outer surface 11*d* of the container 11. For example, the liquid phase refrigerant 20 fed by the pump is branched, a part of the branched liquid phase refrigerant 20 is guided to the supplying unit 12 and supplied to the inner part 11*a* of the container 11, and another part of the branched liquid phase refrigerant 20 is guided to the supplying unit 16 and supplied along the outer surface 11*d* of the container 11. The liquid phase refrigerant 20 supplied by the supplying unit 16 is circulated along the outer surface 11*d* of the container 11, for example, from the upper portion to the lower portion of the container 11 in the example of FIG. 2. While thus circulated from the upper portion to the lower portion, the circulated liquid phase refrigerant 20 exchanges heat with the inner part 11*a* of the container 11, and is consequently increased in temperature. The supplying unit 16 that circulates the liquid phase refrigerant 20 along the outer surface 11*d* of the container 11 does not necessarily need to be in direct contact with the outer surface 11*d* as long as the supplying unit 16 is thermally coupled to the outer surface 11*d*. For example, a thermally conductive layer may be interposed between the outer surface 11*d* of the container 11 and the supplying unit 16.

The discharging unit 17 discharges the liquid phase refrigerant 20 supplied and circulated along the outer surface 11*d* of the container 11 by the supplying unit 16 to the outside of the evaporator 10A. The discharging unit 17 is, for example, coupled to the radiator of the cooling system in which the evaporator 10A is used. The liquid phase refrigerant 20 circulated along the outer surface 11*d* of the container 11 is discharged through the discharging unit 15, and is fed to the radiator. For example, the liquid phase refrigerant 20 discharged through the discharging unit 17 after being circulated along the outer surface 11*d* of the container 11 is merged with the liquid phase refrigerant 20 discharged from the inner part 11*a* of the container 11 through the discharging unit 15, and is then fed to the radiator.

In the evaporator 10A having the configuration as described above, for example, the liquid phase refrigerant 20 at a relatively low temperature, the liquid phase refrigerant 20 being fed from the pump coupled to the radiator of the cooling system in which the evaporator 10A is used, is supplied from the supplying unit 12 to the inner part 11*a* of the container 11, and is stored in the storage part 14. The liquid phase refrigerant 20 stored in the storage part 14 absorbs heat generated in the heat generating body such as an electronic device or the like to be cooled, through the heat absorbing unit 13 located in the lower layer portion of the liquid phase refrigerant 20. Because the outlet 12*a* of the supplying unit 12 reaches the heat absorbing unit 13 or is located in the vicinity of the heat absorbing unit 13, the heat absorbing unit 13 is continuously supplied with the liquid phase refrigerant 20 at a relatively low temperature, the liquid phase refrigerant 20 being fed from the radiator by the pump. The liquid phase refrigerant 20 absorbing heat in the heat absorbing unit 13 may be vaporized in accordance with the heat. Because the heat is absorbed by the liquid phase refrigerant 20, the heat generating body such as an external electronic device or the like is cooled. Due to the vaporization of the liquid phase refrigerant 20 absorbing the heat, the gaseous phase refrigerant 21 is generated. The gaseous phase refrigerant 21 moves (flows or diffuses) to the inside of the storage part 14 or the inside of the space 11*c* in the inner part 11*a* of the container 11.

In the evaporator 10A, the liquid phase refrigerant 20 at a relatively low temperature, the liquid phase refrigerant 20 being fed from the radiator by the pump, is supplied along the outer surface 11*d* of the container 11 by the supplying unit 16. In the evaporator 10A, because the liquid phase refrigerant 20 at a relatively low temperature is thus supplied along the outer surface 11*d* of the container 11 by the supplying unit 16, wall portions of the container 11 (excluding a part corresponding to the heat absorbing unit 13 thermally coupled to the heat generating body) are cooled. The gaseous phase refrigerant 21 generated by the vaporizing (may be referred to as "boiling", "evaporating", and the like) of the liquid phase refrigerant 20 absorbing heat in the heat absorbing unit 13 and moving (flowing or diffusing) to the inner surface 11*b* of the container 11 or the vicinity of the inner surface 11*b* is thereby cooled and condensed. The cooling of the gaseous phase refrigerant 21 and the resulting condensation of the gaseous phase refrigerant 21 occur at least at one of the inside of the liquid phase refrigerant 20 and the inner surface 11*b* of the container 11 or the vicinity of the inner surface 11*b* in the storage part 14 and the inner surface 11*b* or the vicinity of the inner surface 11*b* within the space 11*c*. When the gaseous phase refrigerant 21 is cooled and condensed in the liquid phase refrigerant 20 and at the inner surface 11*b* or the vicinity of the inner surface 11*b* in the storage part 14, the liquid phase refrigerant 20 generated by the condensation is mixed in the liquid phase refrigerant 20 in the storage part 14, and stored in the storage part 14. When the gaseous phase refrigerant 21 is cooled and condensed at the inner surface 11*b* or the vicinity of the inner surface 11*b* within the space 11*c*, the liquid phase refrigerant 20 generated by the condensation drops into the storage part 14, or adheres to the inner surface 11*b* and flows down, is then mixed in the liquid phase refrigerant 20 in the storage part 14, and is stored in the storage part 14.

Incidentally, in the evaporator 10A, not all of the gaseous phase refrigerant 21 generated by the heat absorption of the liquid phase refrigerant 20 necessarily needs to be cooled and condensed within the evaporator 10A. There may be a case where a part of the gaseous phase refrigerant 21 generated by the heat absorption of the liquid phase refrigerant 20 remains without being condensed within the evaporator 10A. The liquid phase refrigerant 20 stored in the storage part 14 may include the gaseous phase refrigerant 21 generated by the heat absorption of the liquid phase refrigerant 20.

The liquid phase refrigerant 20 in the storage part 14, the liquid phase refrigerant 20 being raised to a relatively high temperature due to heat absorption from the heat generating body, or the liquid phase refrigerant 20 including the gaseous phase refrigerant 21 is discharged to the outside of the evaporator 10A through the discharging unit 15 having the inlet 15*a* located below the liquid surface 20*a*. Positioning the inlet 15*a* of the discharging unit 15 below the liquid surface 20*a* of the liquid phase refrigerant 20 suppresses the discharging, to the outside, of the gaseous phase refrigerant 21 that may be present within the space 11*c*. The liquid phase refrigerant 20 supplied along the outer surface 11*d* of the container 11 by the supplying unit 16 and raised to a relatively high temperature by heat exchange with the inner part 11*a* is discharged to the outside of the evaporator 10A through the discharging unit 17. The liquid phase refrigerant 20 discharged through the discharging unit 15 and the discharging unit 17 is, for example, fed to the radiator of the cooling system. Then, the liquid phase refrigerant 20 condensed and lowered in temperature by the heat radiation of the radiator is fed again by the pump to the supplying unit 12 and the supplying unit 16 of the evaporator 10A.

Thus, in the evaporator 10A, the gaseous phase refrigerant 21 generated in the inner part 11*a* of the container 11 by the vaporizing (may be referred to as "boiling", "evaporating", and the like) of the liquid phase refrigerant 20 absorbing heat in the heat absorbing unit 13 is condensed by using the liquid phase refrigerant 20 supplied along the outer surface 11*d* of the container 11 by the supplying unit 16. That is, the evaporator 10A has both of a cooling function of cooling the external heat generating body by absorbing heat generated from the heat generating body by the liquid phase refrigerant 20 and a condensing function of condensing the gaseous phase refrigerant 21 generated by the vaporizing of the liquid phase refrigerant 20 due to the heat absorption and thus returning the gaseous phase refrigerant 21 to the liquid phase refrigerant 20. In the evaporator 10A, the condensing function suppresses discharging of a large amount of gaseous phase refrigerant 21 from the discharging unit 15 together with the liquid phase refrigerant 20. Because the discharging of a large amount of gaseous phase refrigerant 21 from the evaporator 10A is suppressed, stable circulation of the liquid phase refrigerant 20 by the pump may be performed in the cooling system in which the evaporator 10A is used. In the evaporator 10A, stable circulation of the liquid phase refrigerant 20 may be performed while the condensing function suppresses the discharging of the gaseous phase refrigerant 21. It is thus possible to use a condition under which the vaporizing of the liquid phase refrigerant 20 occurs easily. The cooling capacity of the evaporator 10A may be thereby enhanced.

According to the evaporator 10A as illustrated in FIG. 2, the amount of discharge of the gaseous phase refrigerant 21 to the outside is suppressed while the amount of generation of the gaseous phase refrigerant 21 due to the heat absorption of the liquid phase refrigerant 20 is increased, so that stable pump circulation may be realized while a high cooling capacity of the evaporator 10A is realized.

Incidentally, in the evaporator 10A, not all of the gaseous phase refrigerant 21 generated by the heat absorption of the liquid phase refrigerant 20 necessarily needs to be cooled and condensed within the evaporator 10A. In the evaporator 10A, even when not all of the gaseous phase refrigerant 21 generated by the heat absorption of the liquid phase refrigerant 20 is condensed within the evaporator 10A, the amount of discharge of the gaseous phase refrigerant 21 to the outside of the evaporator 10A is reduced, the discharging of a large amount of gaseous phase refrigerant 21 is suppressed, and thus stable pump circulation is realized.

Figure 3:
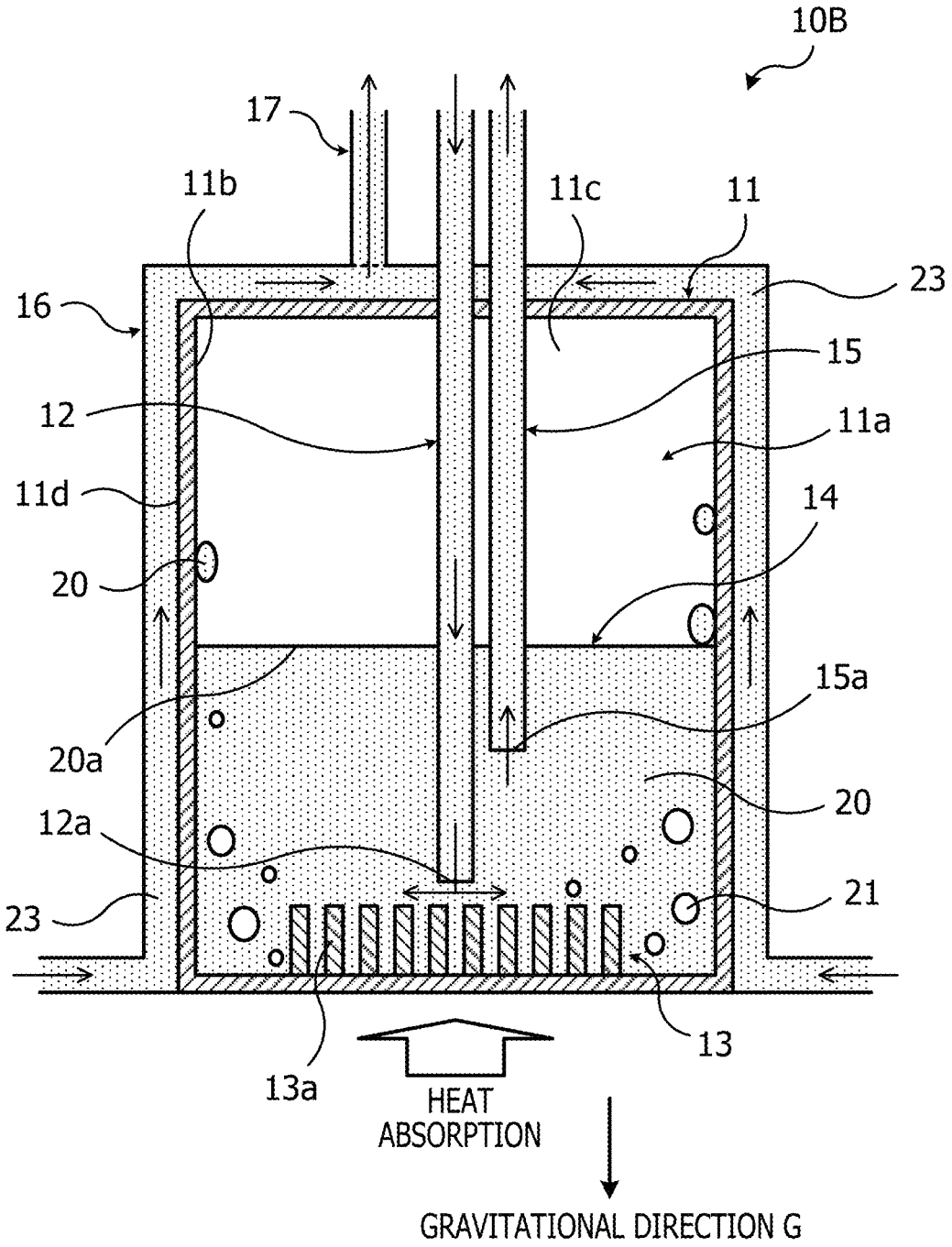
FIG. 3 is a diagram of assistance in explaining a second example of an evaporator according to the first embodiment.

FIG. 3 is a diagram of assistance in explaining a second example of an evaporator according to the first embodiment. FIG. 3 schematically illustrates a fragmentary sectional view of the example of the evaporator.

An evaporator 10B illustrated in FIG. 3 is different from the evaporator 10A illustrated in FIG. 2 described above in that the liquid phase refrigerant 20 supplied along the outer surface 11*d* of the container 11 by the supplying unit 16 is circulated from the lower portion to the upper portion of the container 11.

A heat absorbing unit 13 in which a liquid phase refrigerant 20 absorbs heat from an external heat generating body is provided to the lower portion of the container 11 (lower layer portion of the liquid phase refrigerant 20 in a storage part 14). Therefore, the lower layer portion of the liquid phase refrigerant 20 in the storage part 14, the heat absorbing unit 13 being disposed in the lower layer portion, is raised in temperature easily and is vaporized easily as compared with an upper layer portion of the liquid phase refrigerant 20 on a space 11*c* side. That is, a gaseous phase refrigerant 21 occurs easily in the lower layer portion of the liquid phase refrigerant 20 stored in the storage part 14.

In the evaporator 10B illustrated in FIG. 3, the liquid phase refrigerant 20 is circulated along the outer surface 11*d* of the evaporator 10B from the lower portion to the upper portion of the container 11. While thus circulated from the lower portion to the upper portion, the liquid phase refrigerant 20 is made to exchange heat with the inner part 11*a* of the container 11, and is consequently increased in temperature. Therefore, in the evaporator 10B, the closer a part of the outer surface 11*d* is to the lower layer portion of the liquid phase refrigerant 20 in the storage part 14, the gaseous phase refrigerant 21 occurring easily in the lower layer portion of the liquid phase refrigerant 20, the lower the temperature of the liquid phase refrigerant 20 circulated along the part becomes. The evaporator 10B may thereby quickly condense the gaseous phase refrigerant 21 generated by heat absorption in the heat absorbing unit 13 (for example condense the gaseous phase refrigerant 21 in the liquid phase refrigerant 20), and thus return the gaseous phase refrigerant 21 to the liquid phase refrigerant 20.

The evaporator 10B as illustrated in FIG. 3 also suppresses the amount of discharge of the gaseous phase refrigerant 21 to the outside while increasing the amount of generation of the gaseous phase refrigerant 21 by the heat absorption of the liquid phase refrigerant 20, so that stable pump circulation may be realized while a high cooling capacity of the evaporator 10B is realized.

Second Embodiment

In the following, an example of an evaporator adopting the configuration as described above will be described as a second embodiment.

Figure 4:
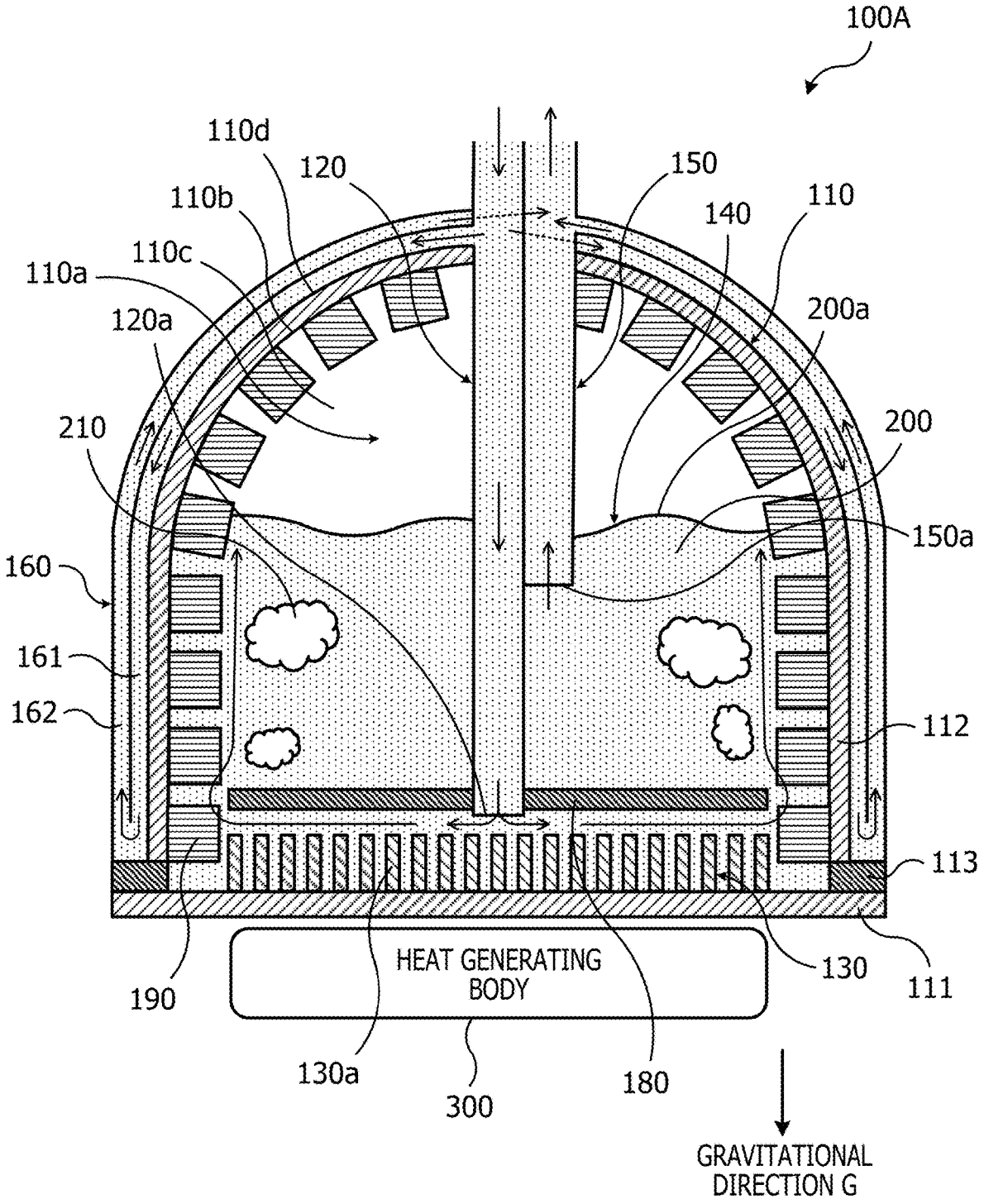
FIG. 4 is a diagram (1) of assistance in explaining an example of an evaporator according to a second embodiment.
Figure 5:
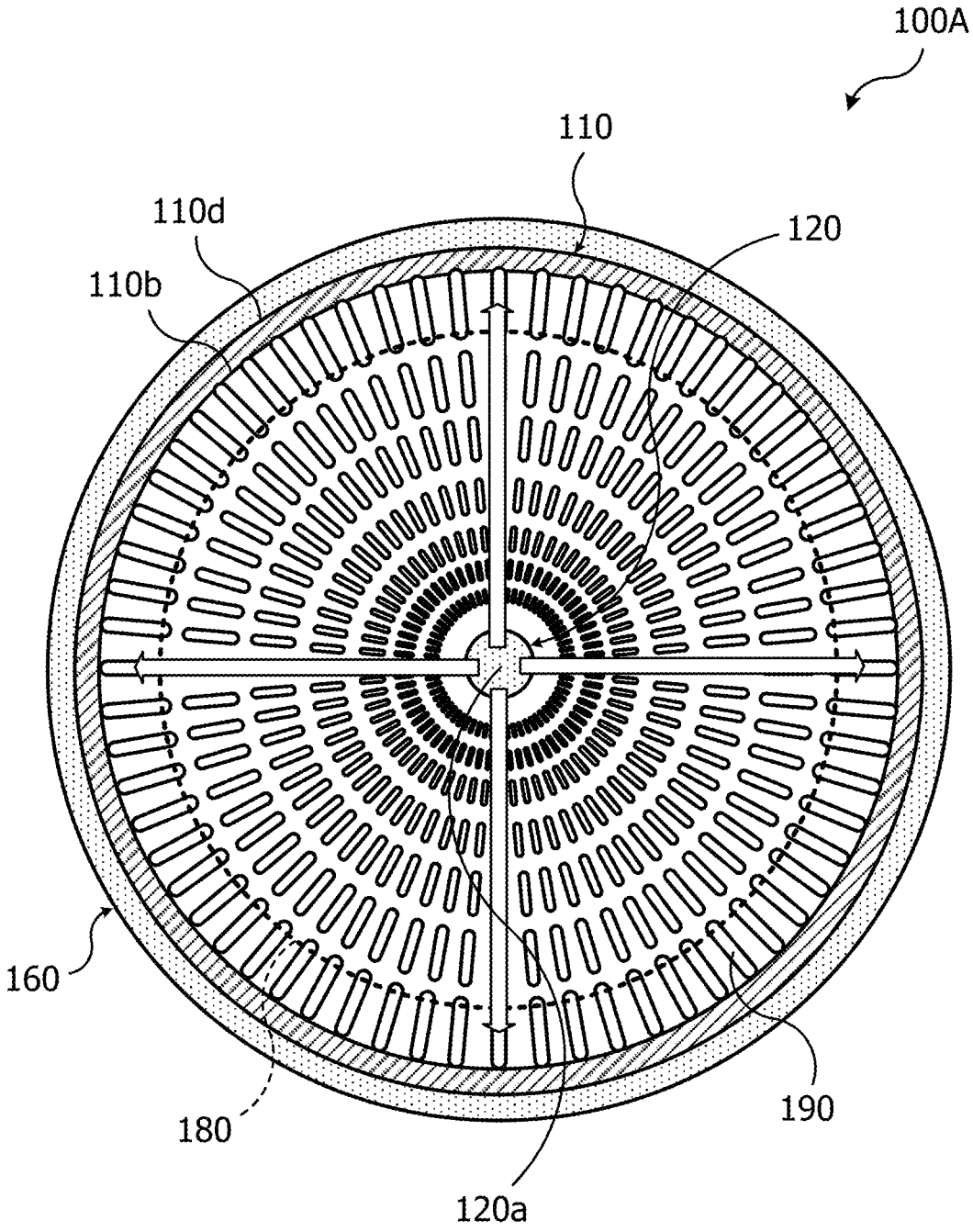
FIG. 5 is a diagram (2) of assistance in explaining the example of an evaporator according to the second embodiment.
Figure 6A:
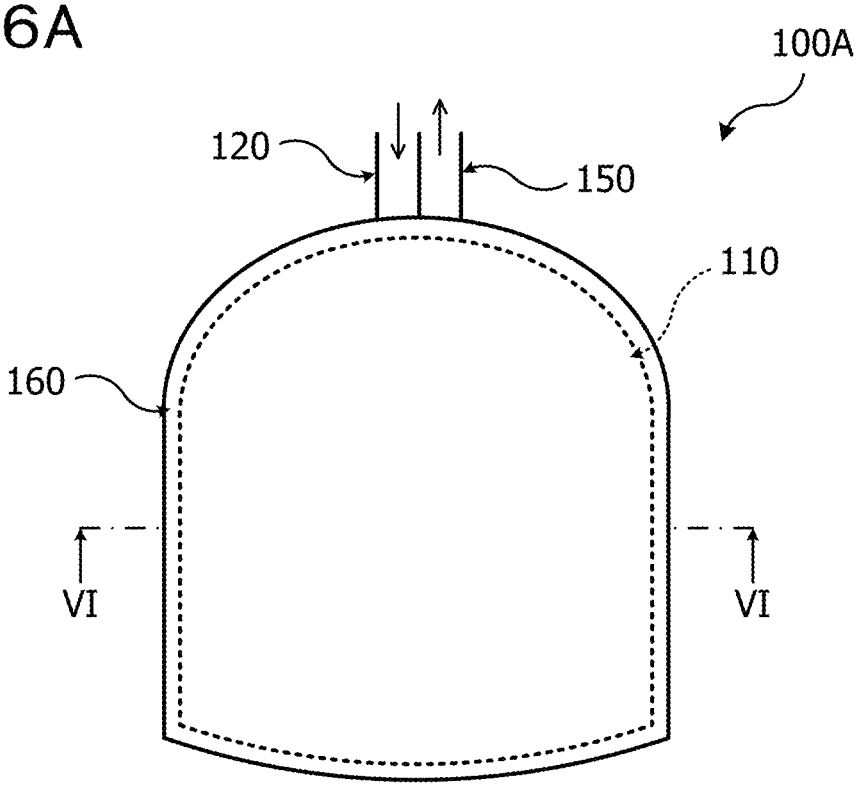
FIGS. 6A and 6B are diagrams (3) of assistance in explaining an example of an evaporator according to the second embodiment.
Figure 6B:
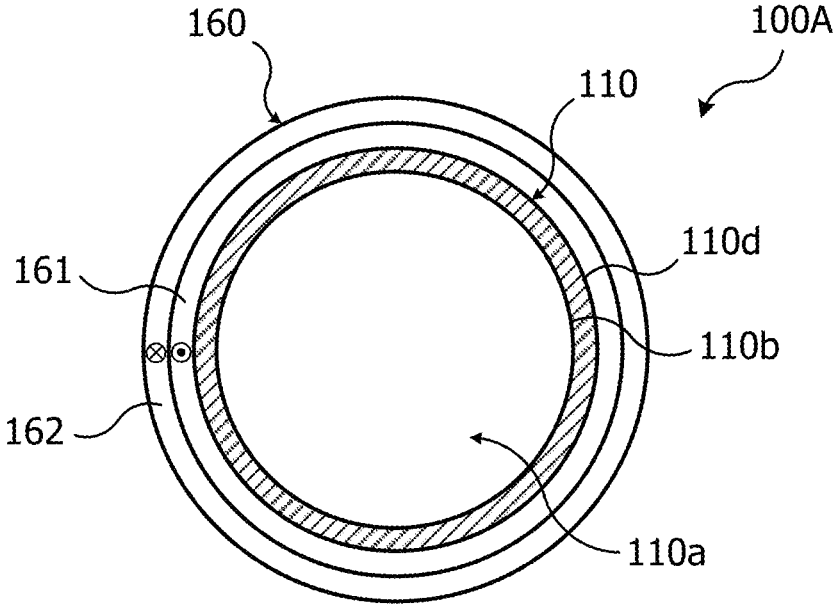

FIGS. 4 to 6B are diagrams of assistance in explaining an example of the evaporator according to the second embodiment. FIG. 4 schematically illustrates a fragmentary sectional view of the example of the evaporator. FIG. 5 schematically illustrates a fragmentary plan view when the evaporator illustrated in FIG. 4 is viewed from below. FIG. 6A schematically illustrates an external view of a container of the evaporator illustrated in FIG. 4. FIG. 6B schematically illustrates a sectional view taken along a line VI-VI of FIG. 6A.

An evaporator 100A illustrated in FIG. 4 includes a container 110, a supplying unit 120 that supplies a liquid phase refrigerant 200 into the container 110, a heat absorbing unit 130 in which the liquid phase refrigerant 200 within the container 110 absorbs heat from an external heat generating body 300, and a storage part 140 that stores the liquid phase refrigerant 200. The evaporator 100A further includes a supplying unit 160 that supplies the liquid phase refrigerant 200 along the surface of the container 110 and a discharging unit 150 that discharges the liquid phase refrigerant 200 within the container 110 and the liquid phase refrigerant 200 supplied to the surface of the container 110 by the supplying unit 160. The evaporator 100A also includes a guide 180 located in the liquid phase refrigerant 200 stored in the storage part 140 and disposed so as to cover the heat absorbing unit 130 and a plurality of fins 190 provided to the container 110.

The container 110 has, in an inner part 110*a*, a space that may store a certain amount of liquid phase refrigerant 200 and a gaseous phase refrigerant 210 generated by boiling (hereafter, may be referred to as "evaporation", "vaporization", and the like) of the liquid phase refrigerant 200. The container 110 includes a bottom plate 111, a dome-shaped main body 112 covering the bottom plate 111, and a coupling portion 113 interposed between the bottom plate 111 and the main body 112 and coupling the bottom plate 111 and the main body 112 to each other. The inner part 110*a* enclosed by the bottom plate 111 and the main body 112 coupled to each other via the coupling portion 113 stores the liquid phase refrigerant 200 and the gaseous phase refrigerant 210 generated by the boiling of the liquid phase refrigerant 200. A material having a relatively high thermal conductivity is used for the bottom plate 111 and the main body 112 of the container 110. For example, metallic materials and alloy materials such as copper, aluminum, brass, stainless steel, and the like are used for the bottom plate 111 and the main body 112. In addition, carbon materials such as graphite and the like or ceramic materials such as aluminum nitride, silicon carbide, and the like may be used for the bottom plate 111 and the main body 112. A material having a relatively low thermal conductivity is used for the coupling portion 113 of the container 110. For example, an inorganic or organic heat insulating material is used for the coupling portion 113. The use of a heat insulating material for the coupling portion 113 may inhibit heat transmitted from the external heat generating body 300 such as an electronic device or the like to be cooled by the evaporator 100A to the bottom plate 111 from being directly transmitted to the main body 112. As illustrated in FIG. 4 and FIG. 5, the plurality of fins 190 protruding to the inner part 110*a* are provided to an inner surface 110*b* of the main body 112 of the container 110.

The supplying unit 120 supplies the liquid phase refrigerant 200 to the inner part 110*a* of the container 110. The supplying unit 120 is, for example, coupled to a pump coupled to a radiator of a cooling system in which the evaporator 100A is used. The liquid phase refrigerant 200 having a relatively low temperature, the liquid phase refrigerant 200 being condensed by the radiator and fed by the pump, is guided to the supplying unit 120, and is supplied from the supplying unit 120 to the inner part 110*a* of the container 110. For example, the liquid phase refrigerant 200 fed by the pump is branched, and a part of the branched liquid phase refrigerant 200 is guided to the supplying unit 120 and supplied to the inner part 110*a* of the container 110. A pipe extending from an upper portion to a lower portion of the container 110, for example, is used as the supplying unit 120. The supplying unit 120 is disposed so as to penetrate the guide 180 covering the heat absorbing unit 130. An outlet 120*a* of the supplying unit 120 is disposed so as to reach the heat absorbing unit 130 or so as to be located in the vicinity of the heat absorbing unit 130. As illustrated in FIG. 4, the liquid phase refrigerant 200 is supplied from the outlet 120*a* of the supplying unit 120 to a region between the bottom plate 111 of the container 110 and the guide 180, and moves (flows or diffuses) toward the inner surface 110*b* of the main body 112 of the container 110, as illustrated in FIG. 4 and FIG. 5, while guided by the guide 180.

The heat absorbing unit 130 is a part where the liquid phase refrigerant 200 supplied by the supplying unit 120 mainly absorbs heat from the external heat generating body 300. For example, the heat absorbing unit 130 is thermally coupled to the heat generating body 300, and heat generated from the heat generating body 300 is absorbed by the liquid phase refrigerant 200 in the heat absorbing unit 130. The heat absorbing unit 130 is provided in the lower layer portion of the liquid phase refrigerant 200 in the storage part 140 in the lower portion of the container 110 illustrated in FIG. 4, and is provided between the bottom plate 111 of the container 110 and the guide 180. The heat absorbing unit 130 is, for example, formed by a plurality of fins 130*a* disposed on the bottom plate 111 of the container 110 so as to protrude to the inner part 110*a*. Incidentally, the bottom plate 111 of the container 110 may be used as the heat absorbing unit 130 or a part of the heat absorbing unit 130.

The guide 180 guides movement of the liquid phase refrigerant 200 supplied to the heat absorbing unit 130 or the vicinity of the heat absorbing unit 130 by the supplying unit 120 and absorbing heat in the heat absorbing unit 130 and the gaseous phase refrigerant 210 generated by the heat absorption toward the inner surface 110*b* of the main body 112 of the container 110. The guide 180 may inhibit the gaseous phase refrigerant 210 generated by the heat absorption in the heat absorbing unit 130 from being mixed into the liquid phase refrigerant 200 above the guide 180 in the storage part 140 and being discharged from the discharging unit 150 before reaching the inner surface 110*b* of the main body 112 or the vicinity of the inner surface 110*b*. A material having a relatively low thermal conductivity is used as the guide 180. For example, an inorganic or organic heat insulating material is used as the guide 180. The use of a heat insulating material for the guide 180 may inhibit heat in the heat absorbing unit 130 below the guide 180 from being transmitted to the liquid phase refrigerant 200 above the guide 180 in the storage part 140.

The storage part 140 is a part that stores the liquid phase refrigerant 200 absorbing heat in the heat absorbing unit 130 and the liquid phase refrigerant 200 cooled and condensed after absorbing heat and evaporating in the heat absorbing unit 130. A certain amount of liquid phase refrigerant 200 is stored in the storage part 140. The liquid phase refrigerant 200 stored in the storage part 140 may include the gaseous phase refrigerant 210 generated by heat absorption in the heat absorbing unit 130. In the inner part 110*a* of the container 110 illustrated in FIG. 4, a space 110*c* that includes the gaseous phase refrigerant 210 generated from the liquid phase refrigerant 200 absorbing heat or which is a vacuum space is present above a liquid surface 200*a* of the liquid phase refrigerant 200 in the storage part 140. The volume of this space is set based on the amount of the liquid phase refrigerant 200 and pressure at a time of filling the liquid phase refrigerant 200 in a decompressed state into the closed circuit (sealed space) of the cooling system in which the evaporator 100A is used. The storage part 140 stores a certain amount of liquid phase refrigerant 200 such that the space 110*c* having the set volume remains in the inner part 110*a* of the container 110.

As illustrated in FIG. 4, the discharging unit 150 discharges the liquid phase refrigerant 200 stored in the storage part 140 or the liquid phase refrigerant 200 including the gaseous phase refrigerant 210 from the inner part 110*a* of the container 110 to the outside. The discharging unit 150 is, for example, coupled to the radiator of the cooling system in which the evaporator 100A is used. The liquid phase refrigerant 200 raised to a relatively high temperature in the evaporator 100A or the liquid phase refrigerant 200 including the gaseous phase refrigerant 210 is discharged through the discharging unit 150, and fed to the radiator. A pipe extending from the upper portion of the container 110 into the liquid phase refrigerant 200 in the storage part 140, for example, is used as the discharging unit 150. The discharging unit 150 is disposed such that an inlet 150*a* of the discharging unit 150 is located below the liquid surface 200*a* of the liquid phase refrigerant 200.

The supplying unit 160 supplies the liquid phase refrigerant 200 along an outer surface 110*d* (surface) of the container 110. The supplying unit 160 is, for example, supplied with the liquid phase refrigerant 200 branched in front of the container 110 (before introduction into the inner part 110*a*) from the supplying unit 120 that supplies the liquid phase refrigerant 200 to the inner part 110*a* of the container 110. As illustrated in FIG. 4 and FIGS. 6A and 6B, the supplying unit 160 includes a flow passage 161 through which the liquid phase refrigerant 200 is circulated from the upper portion to the lower portion of the container 110 and a flow passage 162 through which the liquid phase refrigerant 200 is returned at the lower portion of the container 110 and circulated to the upper portion. The flow passage 161 is a jacket type flow passage provided nearer to the outer surface 110*d* of the container 110. The flow passage 161 circulates, along the outer surface 110*d*, the liquid phase refrigerant 200 distributed from a point of branching from the supplying unit 120 in front of the container 110 to the periphery of the container 110. The flow passage 162 folded back from the flow passage 161 is a jacket type flow passage disposed on the outside of the flow passage 161. The flow passage 162 circulates the liquid phase refrigerant 200 circulated through the flow passage 161 along the outside of the flow passage 161. The inside flow passage 161 of the supplying unit 160 does not necessarily need to be in direct contact with the outer surface 110*d* as long as the flow passage 161 is thermally coupled to the outer surface 110*d*. For example, a thermally conductive layer may be interposed between the outer surface 110*d* of the container 110 and the inside flow passage 161 of the supplying unit 160.

The flow passage 162 of the supplying unit 160 is coupled to the discharging unit 150 that discharges the liquid phase refrigerant 200 from the inner part 110*a* of the container 110. The liquid phase refrigerant 200 circulated through the flow passage 162 is merged with the liquid phase refrigerant 200 discharged from the inner part 110*a* of the container 110, and is discharged to the outside through the discharging unit 150.

In the evaporator 100A (FIG. 4) having the configuration as described above, for example, the liquid phase refrigerant 200 at a relatively low temperature, the liquid phase refrigerant 200 being fed from the pump coupled to the radiator of the cooling system in which the evaporator 100A is used, is supplied to the inner part 110*a* of the container 110 by the supplying unit 120, and is stored in the storage part 140. The liquid phase refrigerant 200 in the storage part 140 absorbs heat generated in the heat generating body 300 in the heat absorbing unit 130 located in the lower layer portion of the liquid phase refrigerant 200. The supplying unit 120 penetrates the guide 180 covering the heat absorbing unit 130, and the outlet 120*a* of the supplying unit 120 reaches the heat absorbing unit 130 or is located in the vicinity of the heat absorbing unit 130. Thus, the liquid phase refrigerant 200 at a relatively low temperature, the liquid phase refrigerant 200 being fed from the radiator by the pump, is continuously supplied to the heat absorbing unit 130 below the guide 180. The liquid phase refrigerant 200 absorbing heat in the heat absorbing unit 130 may be vaporized in accordance with the heat. Because the heat is absorbed by the liquid phase refrigerant 200, the heat generating body 300 is cooled. Due to the boiling of the liquid phase refrigerant 200 absorbing the heat, the liquid phase refrigerant 200 evaporates, and the gaseous phase refrigerant 210 is generated. The gaseous phase refrigerant 210 and the liquid phase refrigerant 200 including the gaseous phase refrigerant 210 move toward the inner surface 110*b* of the main body 112 of the container 110 while guided by the guide 180 above the heat absorbing unit 130, and further move upward along the inner surface 110*b*.

In the evaporator 100A, the liquid phase refrigerant 200 at a relatively low temperature, the liquid phase refrigerant 200 being fed from the radiator by the pump, is supplied along the outer surface 110*d* of the container 110 by the supplying unit 160, circulated from the upper portion to the lower portion of the container 110, and further returned and circulated from the lower portion to the upper portion. In the evaporator 100A, the main body 112 of the container 110 is cooled by thus supplying the liquid phase refrigerant 200 at a relatively low temperature along the outer surface 110*d* of the container 110 by the supplying unit 160 (the flow passage 161 and the flow passage 162, particularly the inside flow passage 161). The gaseous phase refrigerant 210 is thereby cooled and condensed, the gaseous phase refrigerant 210 being generated by the boiling of the liquid phase refrigerant 200 absorbing heat in the heat absorbing unit 130 and moving to the inner surface 110*b* of the main body 112 of the container 110 (inner surface 110*b* on the outside of the liquid phase refrigerant 200 in the storage part 140) or the vicinity of the inner surface 110*b*. In the evaporator 100A, the inner surface 110*b* of the main body 112 is provided with the fins 190 to be increased in surface area, and therefore such cooling of the gaseous phase refrigerant 210 and resulting condensation of the gaseous phase refrigerant 210 are promoted. The cooling of the gaseous phase refrigerant 210 and the resulting condensation of the gaseous phase refrigerant 210 occur at least at one of the inside of the liquid phase refrigerant 200 and the inner surface 110*b* of the container 110 or the vicinity of the inner surface 110*b* in the storage part 140 and the inner surface 110*b* or the vicinity of the inner surface 110*b* within the space 110*c*. When the gaseous phase refrigerant 210 is cooled and condensed in the liquid phase refrigerant 200 and at the inner surface 110*b* or the vicinity of the inner surface 110*b*, the liquid phase refrigerant 200 generated by the condensation is mixed in the liquid phase refrigerant 200 in the storage part 140, and stored in the storage part 140. When the gaseous phase refrigerant 210 is cooled and condensed at the inner surface 110*b* or the vicinity of the inner surface 110*b* within the space 110*c*, the liquid phase refrigerant 200 generated by the condensation drops into the storage part 140, or adheres to the inner surface 110*b* and flows down, is then mixed in the liquid phase refrigerant 200 in the storage part 140, and is stored in the storage part 140.

Incidentally, in the evaporator 100A, not all of the gaseous phase refrigerant 210 generated by the heat absorption of the liquid phase refrigerant 200 necessarily needs to be cooled and condensed within the evaporator 100A. There may be a case where a part of the gaseous phase refrigerant 210 generated by the heat absorption of the liquid phase refrigerant 200 remains without being condensed within the evaporator 100A. The liquid phase refrigerant 200 stored in the storage part 140 may include the gaseous phase refrigerant 210 generated by the heat absorption of the liquid phase refrigerant 200.

The liquid phase refrigerant 200 in the storage part 140, the liquid phase refrigerant 200 being raised to a relatively high temperature due to heat absorption from the heat generating body 300, or the liquid phase refrigerant 200 including the gaseous phase refrigerant 210 is discharged to the outside of the evaporator 100A through the discharging unit 150 having the inlet 150*a* located below the liquid surface 200*a*. Positioning the inlet 150*a* of the discharging unit 150 below the liquid surface 200*a* of the liquid phase refrigerant 200 suppresses the discharging of the gaseous phase refrigerant 210 that may be present within the space 110*c*. The liquid phase refrigerant 200 supplied along the outer surface 110*d* of the container 110 by the supplying unit 160 and raised to a relatively high temperature by heat exchange with the inner part 110*a* is merged with the liquid phase refrigerant 200 discharged through the discharging unit 150, and is discharged to the outside of the evaporator 100A. The liquid phase refrigerant 200 discharged through the discharging unit 150 or the liquid phase refrigerant 200 including the gaseous phase refrigerant 210 is fed to the radiator of the cooling system. Then, the liquid phase refrigerant 200 condensed and lowered in temperature by the heat radiation of the radiator is fed again by the pump to the supplying unit 120 and the supplying unit 160 of the evaporator 100A.

Thus, in the evaporator 100A, the gaseous phase refrigerant 210 generated in the inner part 110*a* of the container 110 by the boiling of the liquid phase refrigerant 200 absorbing heat in the heat absorbing unit 130 is condensed by using the liquid phase refrigerant 200 supplied along the outer surface 110*d* of the container 110 by the supplying unit 160. That is, the evaporator 100A has both of a cooling function of cooling the external heat generating body 300 by absorbing heat generated from the heat generating body 300 by the liquid phase refrigerant 200 and a condensing function of condensing the gaseous phase refrigerant 210 generated by the boiling of the liquid phase refrigerant 200 due to the heat absorption and thus returning the gaseous phase refrigerant 210 to the liquid phase refrigerant 200. In the evaporator 100A, the condensing function suppresses discharging of a large amount of gaseous phase refrigerant 210 from the discharging unit 150 together with the liquid phase refrigerant 200. Because the discharging of a large amount of gaseous phase refrigerant 210 from the evaporator 100A is suppressed, stable circulation of the liquid phase refrigerant 200 by the pump may be performed in the cooling system in which the evaporator 100A is used. In the evaporator 100A, stable circulation of the liquid phase refrigerant 200 may be performed while the condensing function suppresses the discharging of the gaseous phase refrigerant 210. It is thus possible to use a condition under which the boiling of the liquid phase refrigerant 200 occurs easily. The cooling capacity of the evaporator 100A may be thereby enhanced.

According to the evaporator 100A, the amount of discharge of the gaseous phase refrigerant 210 to the outside is suppressed while the amount of generation of the gaseous phase refrigerant 210 due to the heat absorption of the liquid phase refrigerant 200 is increased, so that stable pump circulation may be realized while a high cooling capacity of the evaporator 100A is realized. Further, in a case where a pipe coupled to the radiator from the evaporator 100A is thin, for example, in the cooling system in which the evaporator 100A is used, the discharging of the gaseous phase refrigerant 210 to such a pipe is suppressed, so that damage to the pipe due to steam hammering or the like may be suppressed.

Incidentally, in the evaporator 100A, not all of the gaseous phase refrigerant 210 generated by the heat absorption of the liquid phase refrigerant 200 necessarily needs to be cooled and condensed within the evaporator 100A. In the evaporator 100A, even when not all of the gaseous phase refrigerant 210 generated by the heat absorption of the liquid phase refrigerant 200 is condensed within the evaporator 100A, the amount of discharge of the gaseous phase refrigerant 210 to the outside is reduced, the discharging of a large amount of the gaseous phase refrigerant 210 is suppressed, and thus stable pump circulation is realized.

The cooling system in which the evaporator 100A as described above is used is a sealed structure, and the liquid phase refrigerant 200 is filled in a decompressed state. In such a cooling system, the space that includes the gaseous phase refrigerant 210 generated by the evaporation of the liquid phase refrigerant 200 or which is close to a vacuum has a fixed volume. Accordingly, the container 110 of the evaporator 100A is set to a volume exceeding twice the above-described fixed volume in consideration of volumetric expansion at a time of a phase change to the gaseous phase refrigerant 210, and to a volume that stores the liquid phase refrigerant 200 to such a degree as to be able to cover the inlet 150*a* of the discharging unit 150 even when the evaporator 100A is set in an arbitrary installation attitude. Thus, a state in which the inlet 150*a* of the discharging unit 150 is submerged in the liquid phase refrigerant 200 at all times may be obtained irrespective of the installation attitude of the evaporator 100A, and thereby discharging of the gaseous phase refrigerant 210 from the discharging unit 150 may be suppressed.

Figure 7:
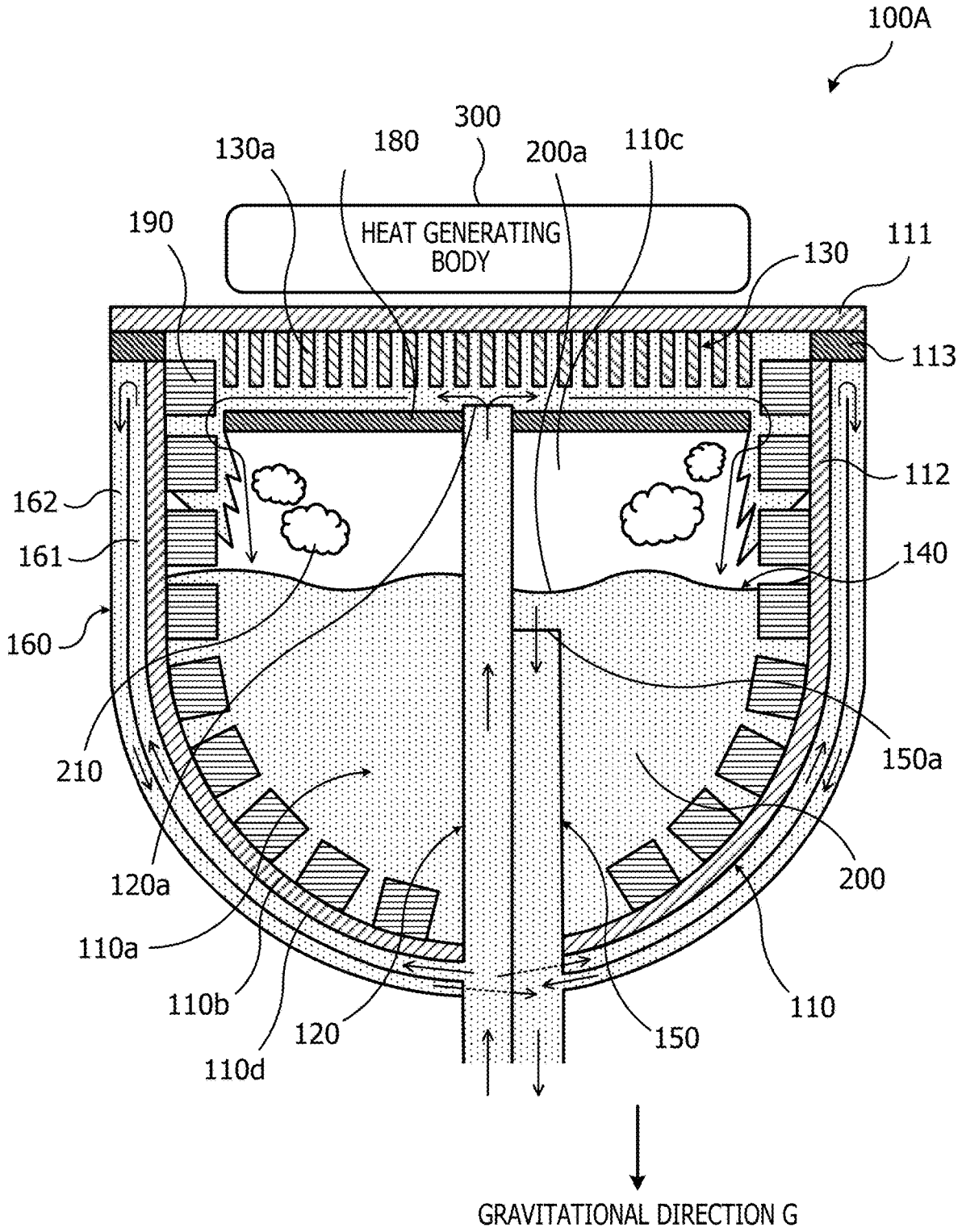
FIG. 7 is a diagram (1) of assistance in explaining an example in which an installation attitude of an evaporator according to the second embodiment is changed.
Figure 8:
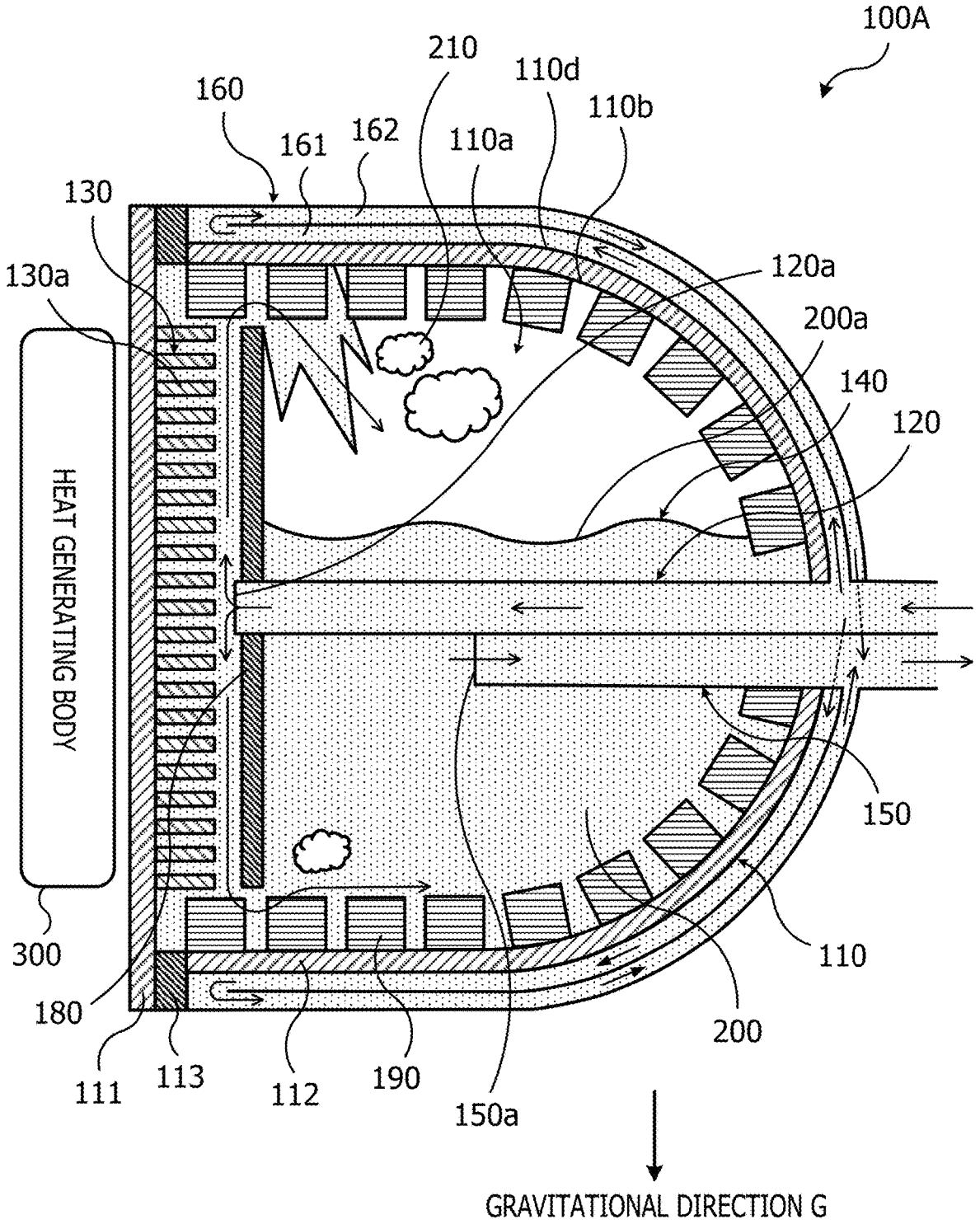
FIG. 8 is a diagram (2) of assistance in explaining an example in which an installation attitude of an evaporator according to the second embodiment is changed.

FIG. 7 and FIG. 8 are diagrams of assistance in explaining an example in which an installation attitude of an evaporator according to the second embodiment is changed. FIG. 7 and FIG. 8 each schematically illustrate a fragmentary sectional view of an example of the evaporator.

FIG. 7 represents an example in a case where the evaporator 100A illustrated in FIG. 4 described above is installed upside down. In the present example, the supplying unit 120 having the outlet 120*a* located above the guide 180 supplies the liquid phase refrigerant 200 to the heat absorbing unit 130 or the vicinity of the heat absorbing unit 130. The gaseous phase refrigerant 210 generated by heat absorption from the heat generating body 300 in the heat absorbing unit 130 above the guide 180 and the liquid phase refrigerant 200 including the gaseous phase refrigerant 210 flow out from between the guide 180 and the inner surface 110*b* of the main body 112 of the container 110. The main body 112 of the container 110 is cooled by the liquid phase refrigerant 200 circulated along the outer surface 110*d* by the supplying unit 160. The gaseous phase refrigerant 210 at the inner surface 110*b* or the vicinity of the inner surface 110*b* or the gaseous phase refrigerant 210 in the liquid phase refrigerant 200 is thereby condensed. The liquid phase refrigerant 200 or the liquid phase refrigerant 200 including the gaseous phase refrigerant 210 in the inner part 110*a* of the container 110 and the liquid phase refrigerant 200 circulated along the outer surface 110*d* are discharged to the outside of the evaporator 100A through the discharging unit 150. Because the container 110 of the evaporator 100A is set to the given volume as described above, the evaporator 100A may also be installed upside down as illustrated in FIG. 7, for example. Because the container 110 is set to the given volume, the inlet 150*a* of the discharging unit 150 is located below the liquid surface 200*a* of the liquid phase refrigerant 200 even when the evaporator 100A is thus installed upside down, and therefore the discharging of the gaseous phase refrigerant 210 from the discharging unit 150 is suppressed.

In addition, FIG. 8 represents an example in a case where the evaporator 100A illustrated in FIG. 4 described above is installed horizontally. In the present example, the supplying unit 120 having the outlet 120*a* located more to the heat absorbing unit 130 side than the guide 180 supplies the liquid phase refrigerant 200 to the heat absorbing unit 130 or the vicinity of the heat absorbing unit 130. The gaseous phase refrigerant 210 generated by heat absorption from the heat generating body 300 in the heat absorbing unit 130 on the side of the guide 180 and the liquid phase refrigerant 200 including the gaseous phase refrigerant 210 flow out from between the guide 180 and the inner surface 110*b* of the main body 112 of the container 110. The main body 112 of the container 110 is cooled by the liquid phase refrigerant 200 circulated along the outer surface 110*d* by the supplying unit 160. The gaseous phase refrigerant 210 at the inner surface 110*b* or the vicinity of the inner surface 110*b* or the gaseous phase refrigerant 210 in the liquid phase refrigerant 200 is thereby condensed. The liquid phase refrigerant 200 or the liquid phase refrigerant 200 including the gaseous phase refrigerant 210 in the inner part 110*a* of the container 110 and the liquid phase refrigerant 200 circulated along the outer surface 110*d* are discharged to the outside of the evaporator 100A through the discharging unit 150. Because the container 110 of the evaporator 100A is set to the given volume as described above, the evaporator 100A may also be installed horizontally as illustrated in FIG. 8, for example. Because the container 110 is set to the given volume, the inlet 150*a* of the discharging unit 150 is located below the liquid surface 200*a* of the liquid phase refrigerant 200 even when the evaporator 100A is thus installed horizontally, and therefore the discharging of the gaseous phase refrigerant 210 from the discharging unit 150 is suppressed.

Thus, in the evaporator 100A in an arbitrary installation attitude, the inlet 150*a* of the discharging unit 150 is positioned below the liquid surface 200*a* of the liquid phase refrigerant 200, so that the discharging of the gaseous phase refrigerant 210 from the discharging unit 150 may be suppressed. Consequently, stable circulation of the liquid phase refrigerant 200 may be performed by suppressing the discharging of the gaseous phase refrigerant 210, and the cooling capacity may be enhanced by using a condition under which the boiling of the liquid phase refrigerant 200 occurs easily. Further, even in the case where the pipe coupled to the evaporator 100A is thin, the discharging of the gaseous phase refrigerant 210 to such a pipe is suppressed, so that damage to the pipe due to steam hammering or the like may be suppressed.

In the above description, the supplying unit having a structure including the jacket type flow passage 161 nearer to the outer surface 110*d* and the jacket type flow passage 162 on the outside, the flow passages 161 and 162 covering the container 110, is illustrated as the supplying unit 160 that supplies the liquid phase refrigerant 200 along the outer surface 110*d* of the container 110 of the evaporator 100A. The structure of the supplying unit 160 is not limited to such a structure.

Figure 9A:
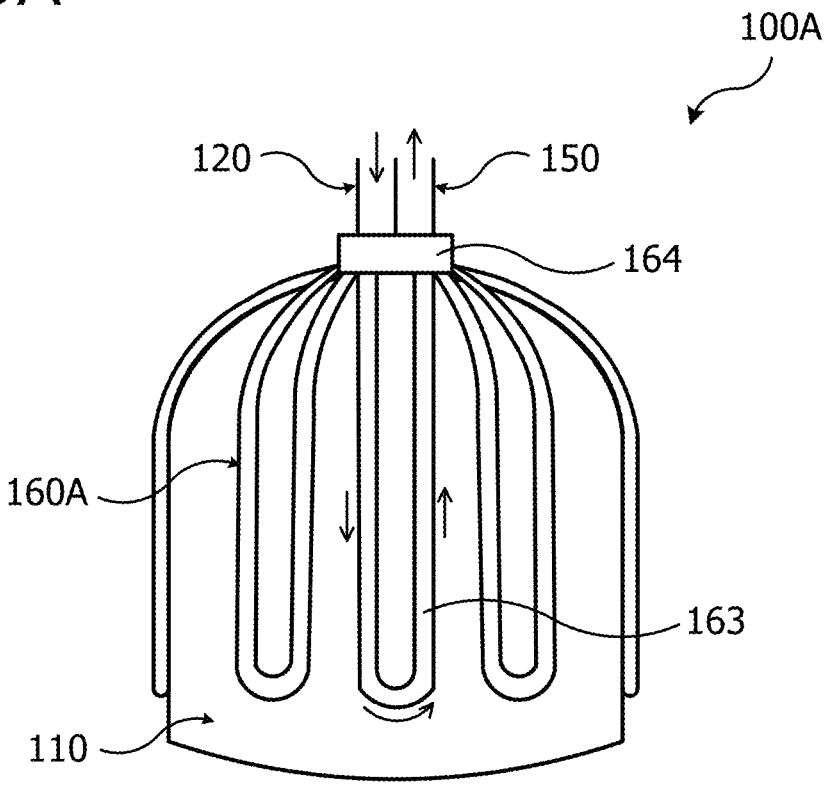
FIGS. 9A and 9B are diagrams of assistance in explaining a modification of an evaporator according to the second embodiment.
Figure 9B:
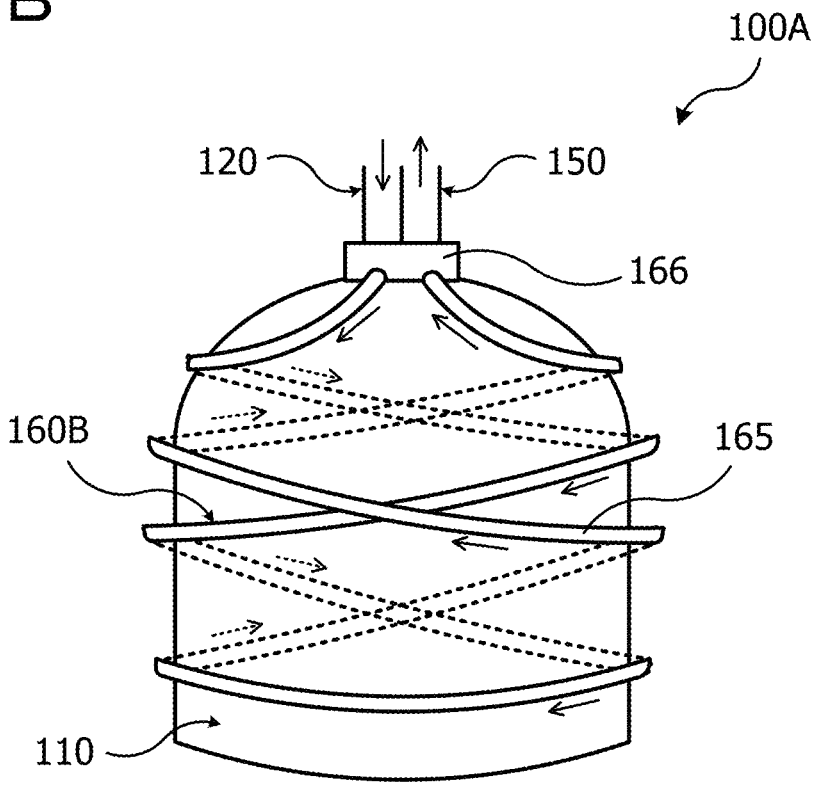

FIGS. 9A and 9B are diagrams of assistance in explaining a modification of an evaporator according to the second embodiment. FIG. 9A and FIG. 9B each schematically illustrate an external view of an example of a container of an evaporator and a supplying unit provided to the outer surface of the container.

The evaporator 100A may be provided with a supplying unit 160A including a plurality of folded pipes 163 as illustrated in FIG. 9A, for example, as the supplying unit that supplies the liquid phase refrigerant 200 along the outer surface 110*d* of the container 110. For example, the liquid phase refrigerant 200 in the supplying unit 120 communicating with the inner part 110*a* of the container 110 is branched and supplied to the plurality of pipes 163 by a regulator 164. Return liquid phase refrigerants 200 in the plurality of pipes 163 are merged with each other in the regulator 164, merged with the liquid phase refrigerant 200 in the discharging unit 150, and discharged. Also with such pipes 163, the liquid phase refrigerant 200 circulated through the pipes 163 cools the outer surface 110*d* of the container 110, and the inner part 110*a* is thereby cooled, so that the gaseous phase refrigerant 210 is condensed.

In addition, the evaporator 100A may be provided with a supplying unit 160B including a spiral-shaped pipe 165 wound around the container 110 as illustrated in FIG. 9B, for example, as the supplying unit that supplies the liquid phase refrigerant 200 along the outer surface 110*d* of the container 110. For example, the liquid phase refrigerant 200 in the supplying unit 120 communicating with the inner part 110*a* of the container 110 is branched and supplied to the pipe 165 by a regulator 166. A return liquid phase refrigerant 200 in the pipe 165 is merged with the liquid phase refrigerant 200 in the discharging unit 150 by the regulator 166, and discharged. Also with such a pipe 165, the liquid phase refrigerant 200 circulated through the pipe 165 cools the outer surface 110*d* of the container 110, and the inner part 110*a* is thereby cooled, so that the gaseous phase refrigerant 210 is condensed.

Third Embodiment

Figure 10:
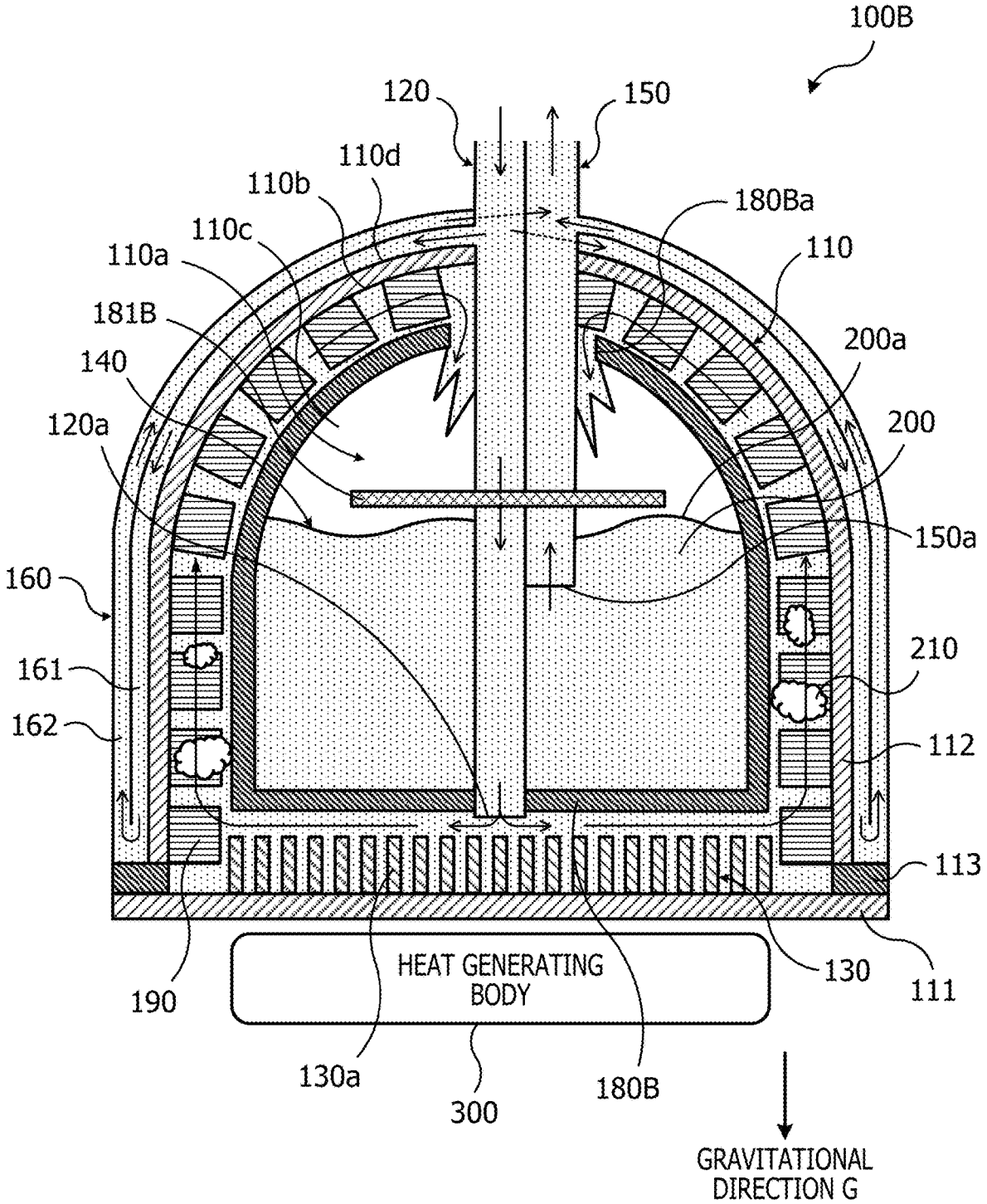
FIG. 10 is a diagram of assistance in explaining an example of an evaporator according to a third embodiment.

FIG. 10 is a diagram of assistance in explaining an example of an evaporator according to a third embodiment. FIG. 10 schematically illustrates a fragmentary sectional view of the example of the evaporator.

An evaporator 100B illustrated in FIG. 10 has a guide 180B that covers a heat absorbing unit 130 and is extended to the vicinity of a supplying unit 120 and a discharging unit 150 along an inner surface 110*b* of a main body 112 of a container 110. The evaporator 100B further includes a barrier 181B provided to the supplying unit 120 and the discharging unit 150 so as to be located in an inner part 110*a* of the container 110 and at a liquid surface 200*a* of a liquid phase refrigerant 200 in a storage part 140 or above the liquid surface 200*a*. The evaporator 100B is different from the evaporator 100A (FIGS. 4 to 8) described in the foregoing second embodiment in such a respect.

A part of the guide 180B, the part being extended to the vicinity of the supplying unit 120 and the discharging unit 150 along the inner surface 110*b* of the main body 112 of the container 110, is disposed on the inside of fins 190 protruding from the inner surface 110*b*. The guide 180B guides movement of the liquid phase refrigerant 200 supplied to the heat absorbing unit 130 or the vicinity of the heat absorbing unit 130 by the supplying unit 120 and absorbing heat in the heat absorbing unit 130 and a gaseous phase refrigerant 210 generated by the heat absorption, the movement being a movement toward the inner surface 110*b* of the main body 112 of the container 110 and a movement along the inner surface 110*b*. The guide 180B may inhibit the gaseous phase refrigerant 210 generated by the heat absorption in the heat absorbing unit 130 from being mixed into the liquid phase refrigerant 200 in the storage part 140 inside the guide 180B and being discharged from the discharging unit 150 before reaching the inner surface 110*b* of the main body 112 or the vicinity of the inner surface 110*b*. A material having a relatively low thermal conductivity, for example, an inorganic or organic heat insulating material is used for the guide 180B. The use of a heat insulating material suppresses heat exchange between the inside and outside of the guide 180B.

In the evaporator 100B, the supplying unit 120 having an outlet 120*a* located below a part of the guide 180B, the part covering the heat absorbing unit 130, supplies the liquid phase refrigerant 200 to the heat absorbing unit 130 or the vicinity of the heat absorbing unit 130. The gaseous phase refrigerant 210 generated by heat absorption from a heat generating body 300 in the heat absorbing unit 130 and the liquid phase refrigerant 200 including the gaseous phase refrigerant 210 move toward the inner surface 110*b* of the main body 112 of the container 110 while guided by a part of the guide 180B, the part covering the heat absorbing unit 130. The gaseous phase refrigerant 210 and the liquid phase refrigerant 200 including the gaseous phase refrigerant 210 after moving toward the inner surface 110*b* of the main body 112 of the container 110 further move between the inner surface 110*b* of the main body 112 and the guide 180B to the vicinity of the supplying unit 120 and the discharging unit 150.

The gaseous phase refrigerant 210 moved to the inner surface 110*b* of the main body 112 of the container 110 or the vicinity of the inner surface 110*b* and the gaseous phase refrigerant 210 moving between the inner surface 110*b* of the main body 112 and the guide 180B are cooled and condensed by the liquid phase refrigerant 200 circulated along an outer surface 110*d* by a supplying unit 160. The liquid phase refrigerant 200 in which the gaseous phase refrigerant 210 is condensed or the liquid phase refrigerant 200 including the gaseous phase refrigerant 210 flows down to a space 110*c* and the storage part 140 from an opening 180Ba of the guide 180B, the opening 180Ba being disposed in the vicinity of the supplying unit 120 and the discharging unit 150. The liquid phase refrigerant 200 or the liquid phase refrigerant 200 including the gaseous phase refrigerant 210 in the storage part 140 and the liquid phase refrigerant 200 circulated along the outer surface 110*d* are discharged to the outside of the evaporator 100B through the discharging unit 150.

The barrier 181B is provided where the liquid phase refrigerant 200 flowing down from the opening 180Ba of the guide 180B flows in. The barrier 181B suppresses the mixing in of the gaseous phase refrigerant 210 included in the liquid phase refrigerant 200 flowing down from the opening 180Ba of the guide 180B, the mixing of the gaseous phase refrigerant 210 into the space 110*c*, and the mixing in of the gaseous phase refrigerant 210 as the liquid phase refrigerant 200 in the storage part 140 waves during the flow-down.

Thus, in the evaporator 100B, the guide 180B moves the gaseous phase refrigerant 210 generated by the boiling of the liquid phase refrigerant 200 absorbing heat in the heat absorbing unit 130 along the inner surface 110*b* of the main body 112 of the container 110. Because the gaseous phase refrigerant 210 is thus moved along the inner surface 110*b* of the main body 112 of the container 110, the gaseous phase refrigerant 210 is effectively cooled and condensed by using the liquid phase refrigerant 200 supplied along the outer surface 110*d* of the main body 112 of the container 110 by the supplying unit 160.

The evaporator 100B, also, may suppress the amount of discharge of the gaseous phase refrigerant 210 to the outside while increasing the amount of generation of the gaseous phase refrigerant 210 due to heat absorption. Thus, stable pump circulation may be realized while a high cooling capacity of the evaporator 100B is realized.

Incidentally, in the evaporator 100B, not all of the gaseous phase refrigerant 210 generated by the heat absorption of the liquid phase refrigerant 200 necessarily needs to be cooled and condensed within the evaporator 100B. In the evaporator 100B, even when not all of the gaseous phase refrigerant 210 generated by the heat absorption of the liquid phase refrigerant 200 is condensed within the evaporator 100B, the amount of discharge of the gaseous phase refrigerant 210 to the outside of the evaporator 100B is reduced, and thus stable pump circulation is realized.

The evaporator 100B may also be set in an arbitrary installation attitude by setting the container 110 to a given volume.

Figure 11:
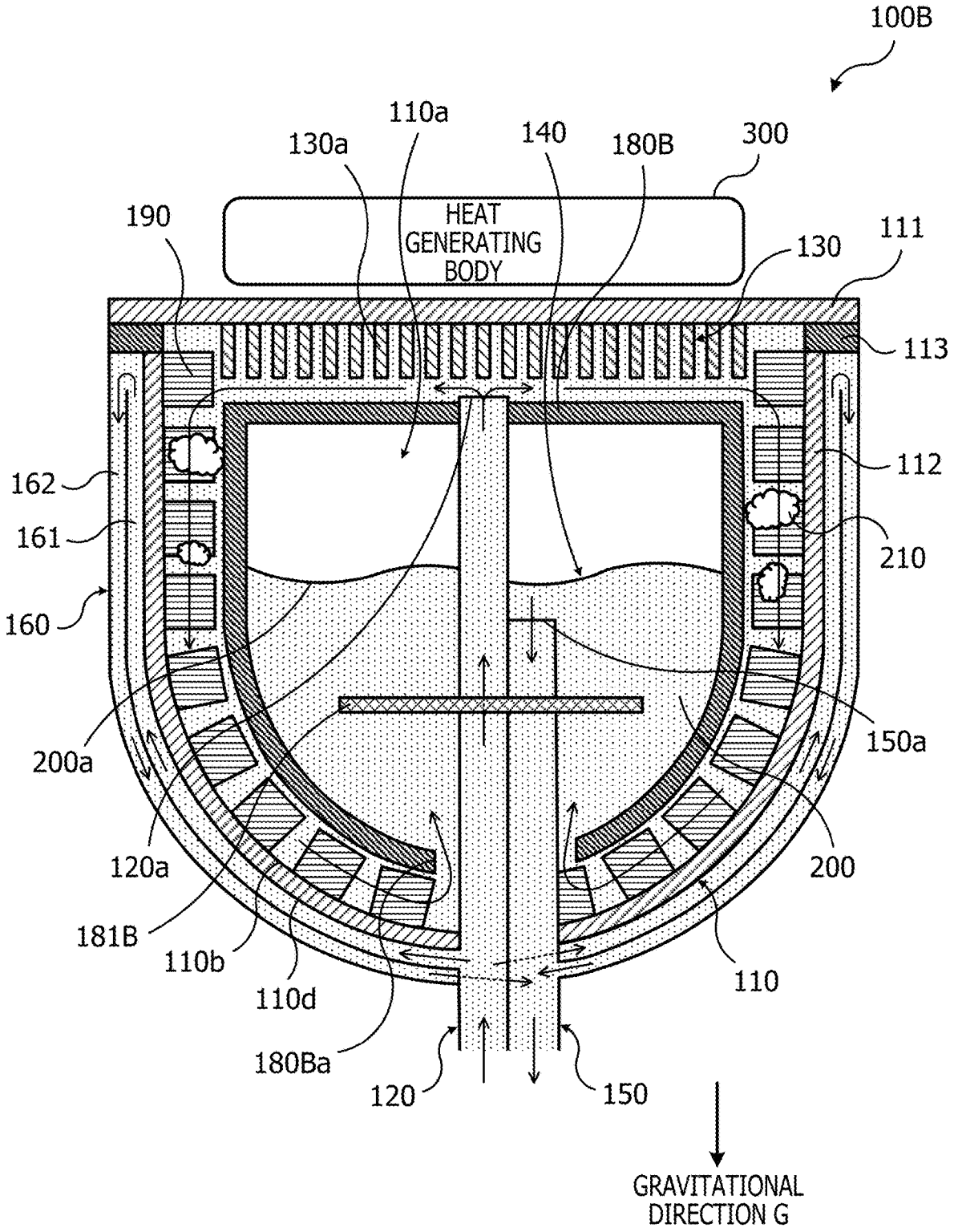
FIG. 11 is a diagram (1) of assistance in explaining an example in which an installation attitude of an evaporator according to the third embodiment is changed.
Figure 12:
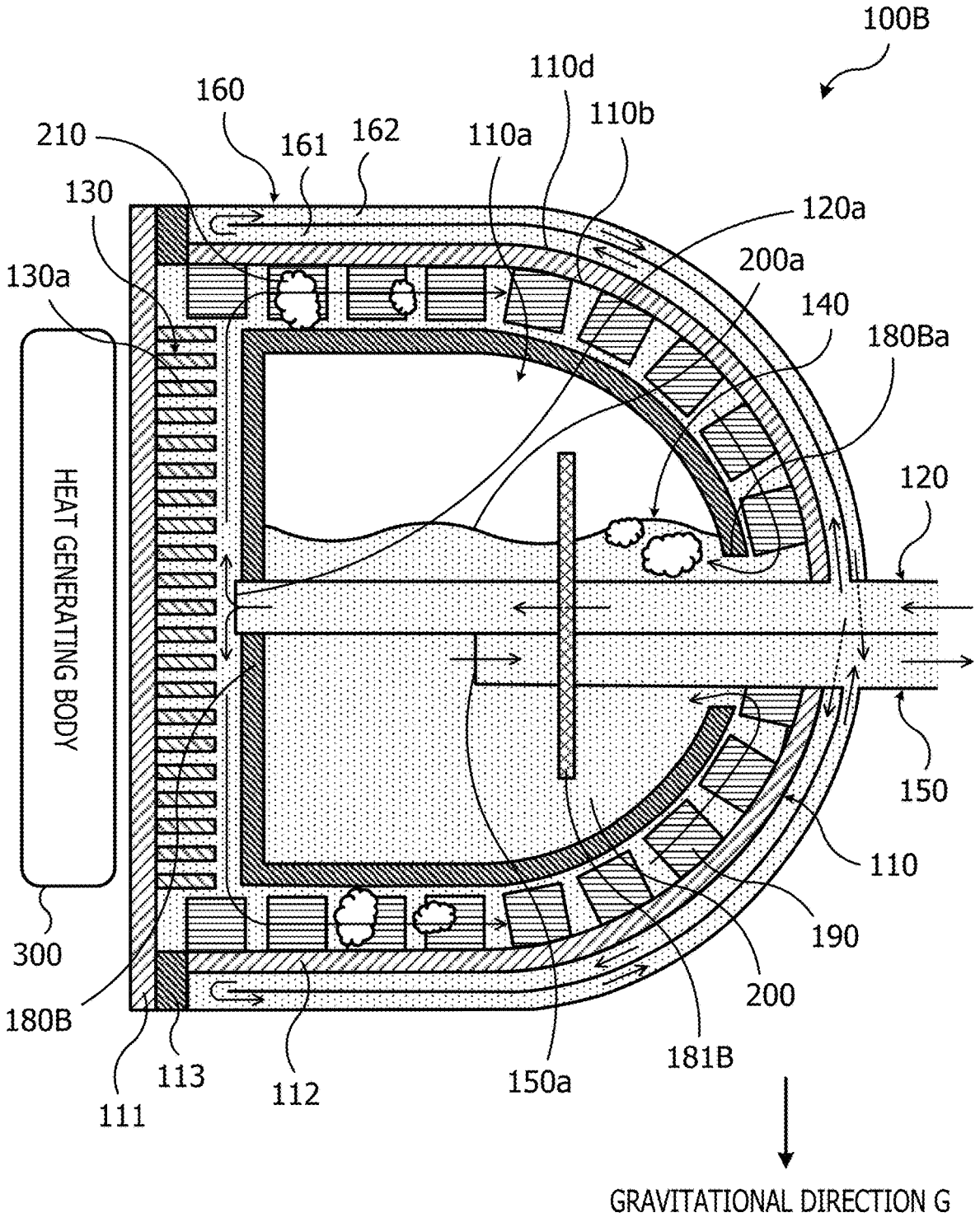
FIG. 12 is a diagram (2) of assistance in explaining an example in which an installation attitude of an evaporator according to the third embodiment is changed.

FIG. 11 and FIG. 12 are diagrams of assistance in explaining examples in which an installation attitude of an evaporator according to the third embodiment is changed. FIG. 11 and FIG. 12 each schematically illustrate a fragmentary sectional view of an example of the evaporator.

FIG. 11 represents an example in a case where the evaporator 100B illustrated in FIG. 10 described above is installed upside down. In the present example, the supplying unit 120 having the outlet 120*a* located above the guide 180B supplies the liquid phase refrigerant 200 to the heat absorbing unit 130 or the vicinity of the heat absorbing unit 130. The gaseous phase refrigerant 210 generated by heat absorption from the heat generating body 300 in the heat absorbing unit 130 and the liquid phase refrigerant 200 including the gaseous phase refrigerant 210 move toward the inner surface 110*b* of the main body 112 of the container 110 and further move along the inner surface 110*b* while guided by the guide 180B, and flow out from the opening 180Ba. The main body 112 of the container 110 is cooled by the liquid phase refrigerant 200 circulated along the outer surface 110*d* by the supplying unit 160. The gaseous phase refrigerant 210 at the inner surface 110*b* or the vicinity of the inner surface 110*b* and the gaseous phase refrigerant 210 moving along the inner surface 110*b* are thereby condensed. The liquid phase refrigerant 200 or the liquid phase refrigerant 200 including the gaseous phase refrigerant 210 in the inner part 110*a* of the container 110 and the liquid phase refrigerant 200 circulated along the outer surface 110*d* are discharged to the outside of the evaporator 100B through the discharging unit 150. Because the container 110 of the evaporator 100B is set to the given volume, the evaporator 100B may also be installed upside down as illustrated in FIG. 11, for example. Because the container 110 is set to the given volume, the inlet 150*a* of the discharging unit 150 is located below the liquid surface 200*a* of the liquid phase refrigerant 200 even when the evaporator 100B is installed upside down, and therefore the discharging of the gaseous phase refrigerant 210 from the discharging unit 150 is suppressed.

In addition, FIG. 12 represents an example in a case where the evaporator 100B illustrated in FIG. 10 described above is installed horizontally. In the present example, the supplying unit 120 having the outlet 120*a* located more to the heat absorbing unit 130 side than the guide 180B supplies the liquid phase refrigerant 200 to the heat absorbing unit 130 or the vicinity of the heat absorbing unit 130. The gaseous phase refrigerant 210 generated by heat absorption from the heat generating body 300 in the heat absorbing unit 130 and the liquid phase refrigerant 200 including the gaseous phase refrigerant 210 move toward the inner surface 110*b* of the main body 112 of the container 110 and further move along the inner surface 110*b* while guided by the guide 180B, and flow out from the opening 180Ba. The main body 112 of the container 110 is cooled by the liquid phase refrigerant 200 circulated along the outer surface 110*d* by the supplying unit 160. The gaseous phase refrigerant 210 at the inner surface 110*b* or the vicinity of the inner surface 110*b* and the gaseous phase refrigerant 210 moving along the inner surface 110*b* are thereby condensed. The liquid phase refrigerant 200 or the liquid phase refrigerant 200 including the gaseous phase refrigerant 210 in the inner part 110*a* of the container 110 and the liquid phase refrigerant 200 circulated along the outer surface 110*d* are discharged to the outside of the evaporator 100B through the discharging unit 150. Because the container 110 of the evaporator 100B is set to the given volume, the evaporator 100B may also be installed horizontally as illustrated in FIG. 12, for example. Because the container 110 is set to the given volume, the inlet 150*a* of the discharging unit 150 is located below the liquid surface 200*a* of the liquid phase refrigerant 200 even when the evaporator 100B is installed horizontally, and therefore the discharging of the gaseous phase refrigerant 210 from the discharging unit 150 is suppressed.

Fourth Embodiment

Figure 13:
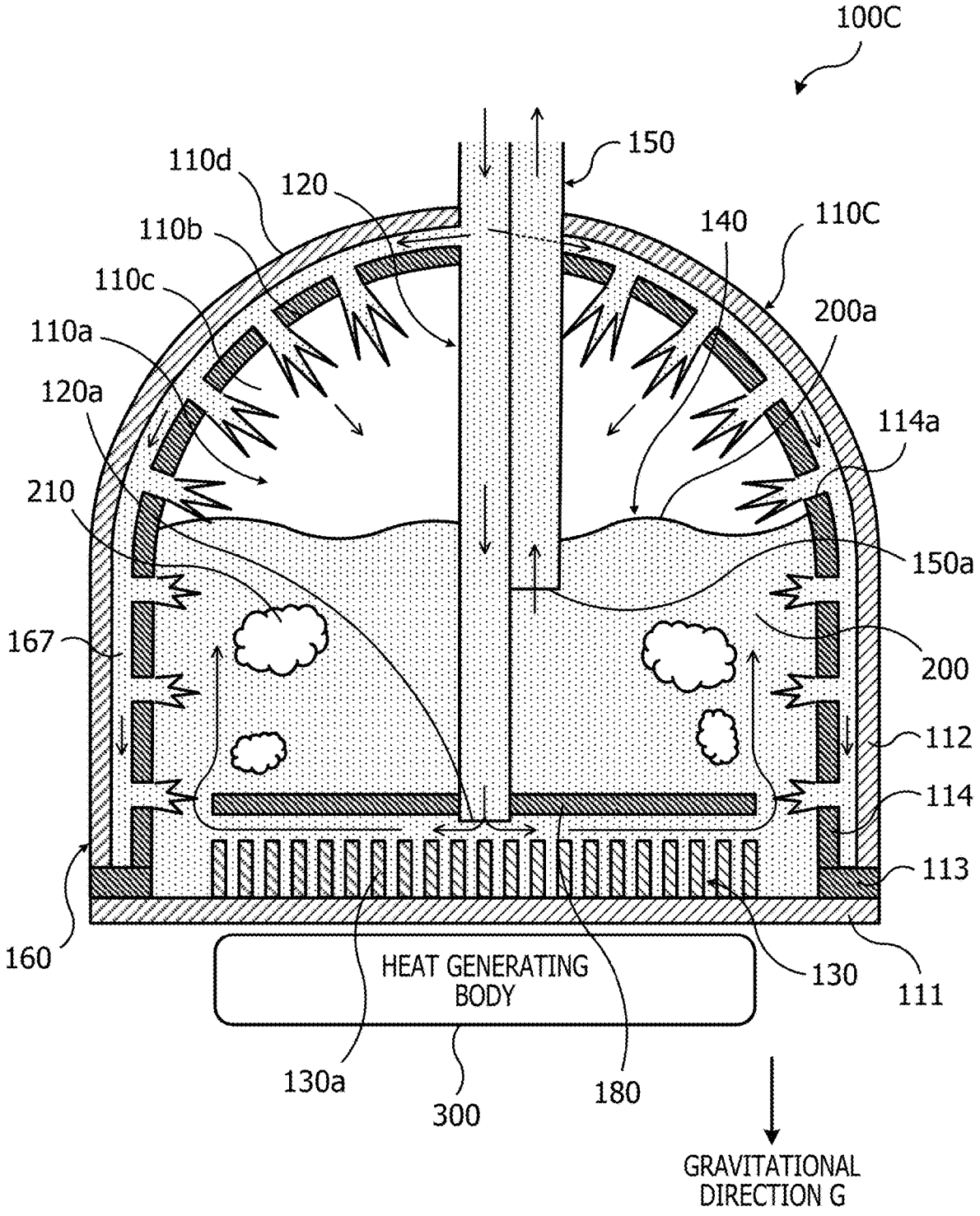
FIG. 13 is a diagram of assistance in explaining an example of an evaporator according to a fourth embodiment.

FIG. 13 is a diagram of assistance in explaining an example of an evaporator according to a fourth embodiment. FIG. 13 schematically illustrates a fragmentary sectional view of the example of the evaporator.

An evaporator 100C illustrated in FIG. 13 includes a container 110C including a bottom plate 111, a main body 112 covering the bottom plate 111, a secondary main body 114 disposed on the inside of the main body 112, and a coupling portion 113 interposed between the bottom plate 111 and the main body 112 and the secondary main body 114 and coupling the bottom plate 111 to the main body 112 and the secondary main body 114. A flow passage 167 that makes a liquid phase refrigerant 200 circulated along the main body 112 and the secondary main body 114 is disposed between the main body 112 and the secondary main body 114. The flow passage 167 functions as a supplying unit 160 (or a part of the supplying unit 160) that supplies the liquid phase refrigerant 200 along the surface of the container 110C. The liquid phase refrigerant 200 to be supplied to an inner part 110*a* of the container 110C by a supplying unit 120, for example, is branched and supplied to the flow passage 167. A plurality of holes 114*a* penetrating the secondary main body 114 of the container 110C and communicating with the flow passage 167 are provided to the secondary main body 114 of the container 110C. The liquid phase refrigerant 200 circulated through the flow passage 167 from an upper portion to a lower portion of the container 110 is introduced into the inner part 110*a* of the container 110C from the plurality of holes 114*a* provided to the secondary main body 114 of the container 110C. A heat insulating material is preferably used for the secondary main body 114 of the container 110C to suppress heat exchange between the liquid phase refrigerant 200 circulated through the flow passage 167 and the inner part 110*a* of the container 110C. Incidentally, the fins 190 as described above are not provided in the evaporator 100C. The evaporator 100C is different from the evaporator 100A (FIGS. 4 to 8) described in the foregoing second embodiment in such a respect.

In the evaporator 100C, the supplying unit 120 having an outlet 120*a* located below a guide 180 supplies the liquid phase refrigerant 200 to a heat absorbing unit 130 or the vicinity of the heat absorbing unit 130. A gaseous phase refrigerant 210 generated by heat absorption from a heat generating body 300 in the heat absorbing unit 130 and the liquid phase refrigerant 200 including the gaseous phase refrigerant 210 move toward an inner surface 110*b* of the container 110C (secondary main body 114 of the container 110C). The gaseous phase refrigerant 210 and the liquid phase refrigerant 200 including the gaseous phase refrigerant 210 that have moved toward the inner surface 110*b* of the container 110C further move upward along the secondary main body 114.

The liquid phase refrigerant 200 circulated through the flow passage 167 is introduced into the inner part 110*a* of the container 110C from the holes 114*a* of the secondary main body 114. For example, the liquid phase refrigerant 200 circulated through the flow passage 167 is jetted from the holes 114*a* of the secondary main body 114 to the inner part 110*a*. The liquid phase refrigerant 200 introduced from the holes 114*a* of the secondary main body 114 cools the gaseous phase refrigerant 210 and the liquid phase refrigerant 200 including the gaseous phase refrigerant 210 in the inner part 110*a* (within a space 110*c* and within a storage part 140), and condenses the gaseous phase refrigerant 210. The liquid phase refrigerant 200 at a relatively low temperature is, for example, branched from the supplying unit 120 and supplied to the flow passage 167, the liquid phase refrigerant 200 being fed from a pump coupled to a radiator of a cooling system in which the evaporator 100C is used. When the liquid phase refrigerant 200 at such a relatively low temperature is directly introduced into the inner part 110*a* through the holes 114*a* of the secondary main body 114 of the container 110C, the gaseous phase refrigerant 210 and the liquid phase refrigerant 200 including the gaseous phase refrigerant 210 in the inner part 110*a* are cooled sharply, and the gaseous phase refrigerant 210 is condensed effectively. The liquid phase refrigerant 200 generated by the condensation is stored in the storage part 140. The liquid phase refrigerant 200 or the liquid phase refrigerant 200 including the gaseous phase refrigerant 210 in the storage part 140 is discharged to the outside of the evaporator 100C through a discharging unit 150.

The evaporator 100C, also, may suppress the amount of discharge of the gaseous phase refrigerant 210 to the outside while increasing the amount of generation of the gaseous phase refrigerant 210 due to heat absorption. Thus, stable pump circulation may be realized while a high cooling capacity of the evaporator 100C is realized.

Incidentally, in the evaporator 100C, not all of the gaseous phase refrigerant 210 generated by the heat absorption of the liquid phase refrigerant 200 necessarily needs to be cooled and condensed within the evaporator 100C. In the evaporator 100C, even when not all of the gaseous phase refrigerant 210 generated by the heat absorption of the liquid phase refrigerant 200 is condensed within the evaporator 100C, the amount of discharge of the gaseous phase refrigerant 210 to the outside of the evaporator 100C is reduced, and thus stable pump circulation is realized.

In addition, in the evaporator 100C, an inlet 150*a* of the discharging unit 150 may be positioned below a liquid surface 200*a* of the liquid phase refrigerant 200 in an arbitrary installation attitude by setting the container 110C to a given volume as described in relation to the above-described evaporator 100A or the like. Thus, the evaporator 100C set in an arbitrary installation attitude may suppress the discharging of the gaseous phase refrigerant 210 from the discharging unit 150.

Fifth Embodiment

Figure 14:
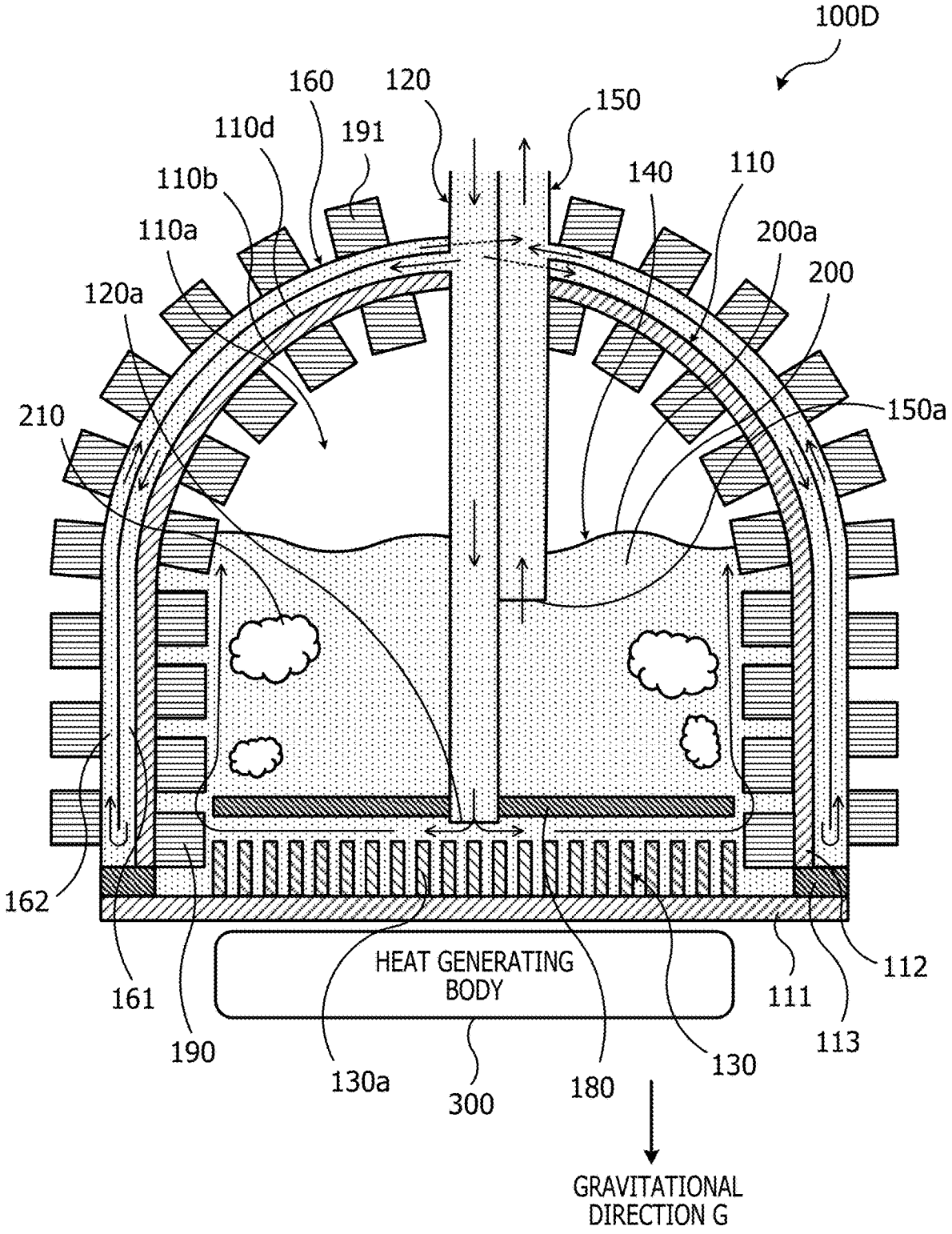
FIG. 14 is a diagram of assistance in explaining an example of an evaporator according to a fifth embodiment.

FIG. 14 is a diagram of assistance in explaining an example of an evaporator according to a fifth embodiment. FIG. 14 schematically illustrates a fragmentary sectional view of the example of the evaporator.

An evaporator 100D illustrated in FIG. 14 includes a plurality of fins 191 on the outside of a supplying unit 160 that supplies a liquid phase refrigerant 200 along an outer surface 110*d* of a container 110, the plurality of fins 191 being disposed so as to be thermally coupled to the supplying unit 160. The evaporator 100D is different from the evaporator 100A (FIGS. 4 to 8) described in the foregoing second embodiment in such a respect.

The liquid phase refrigerant 200 supplied to the supplying unit 160 is increased in temperature by heat exchange with an inner part 110*a* while circulated through an inside flow passage 161 from an upper portion to a lower portion of the container 110. The liquid phase refrigerant 200 circulated through the inside flow passage 161 is further increased in temperature by heat exchange with the inner part 110*a* and the inside flow passage 161 while returned and circulated through an outside flow passage 162 from the lower portion to the upper portion of the container 110. When the plurality of fins 191 thermally coupled to the supplying unit 160 are arranged on the outside of the supplying unit 160 as in the evaporator 100D, the surface area of the supplying unit 160 is increased, and thus efficiency of heat radiation from the supplying unit 160 is enhanced. Consequently, an increase in the temperature of the liquid phase refrigerant 200 circulated through the supplying unit 160 is suppressed, and the temperature of the liquid phase refrigerant 200 fed to a radiator of a cooling system through a discharging unit 150, for example, is decreased, so that efficiency of heat radiation in the radiator is enhanced. In addition, the boiling of the liquid phase refrigerant 200 circulated through the supplying unit 160 and resulting generation of a gaseous phase refrigerant 210 are suppressed.

The evaporator 100D, also, may suppress the amount of discharge of the gaseous phase refrigerant 210 to the outside while increasing the amount of generation of the gaseous phase refrigerant 210 due to heat absorption. Thus, stable pump circulation may be realized while a high cooling capacity of the evaporator 100D is realized.

Incidentally, a method of providing the outside of the supplying unit 160 with the plurality of fins 191 thermally coupled to the supplying unit 160 as in the evaporator 100D may be similarly applied also to the evaporator 100B (FIGS. 10 to 12) described in the foregoing third embodiment. In addition, the method of thus providing the plurality of fins 191 may be similarly applied also to the main body 112 of the container 110 of the evaporator 100C (FIG. 13) described in the foregoing fourth embodiment.

Sixth Embodiment

Figure 15:
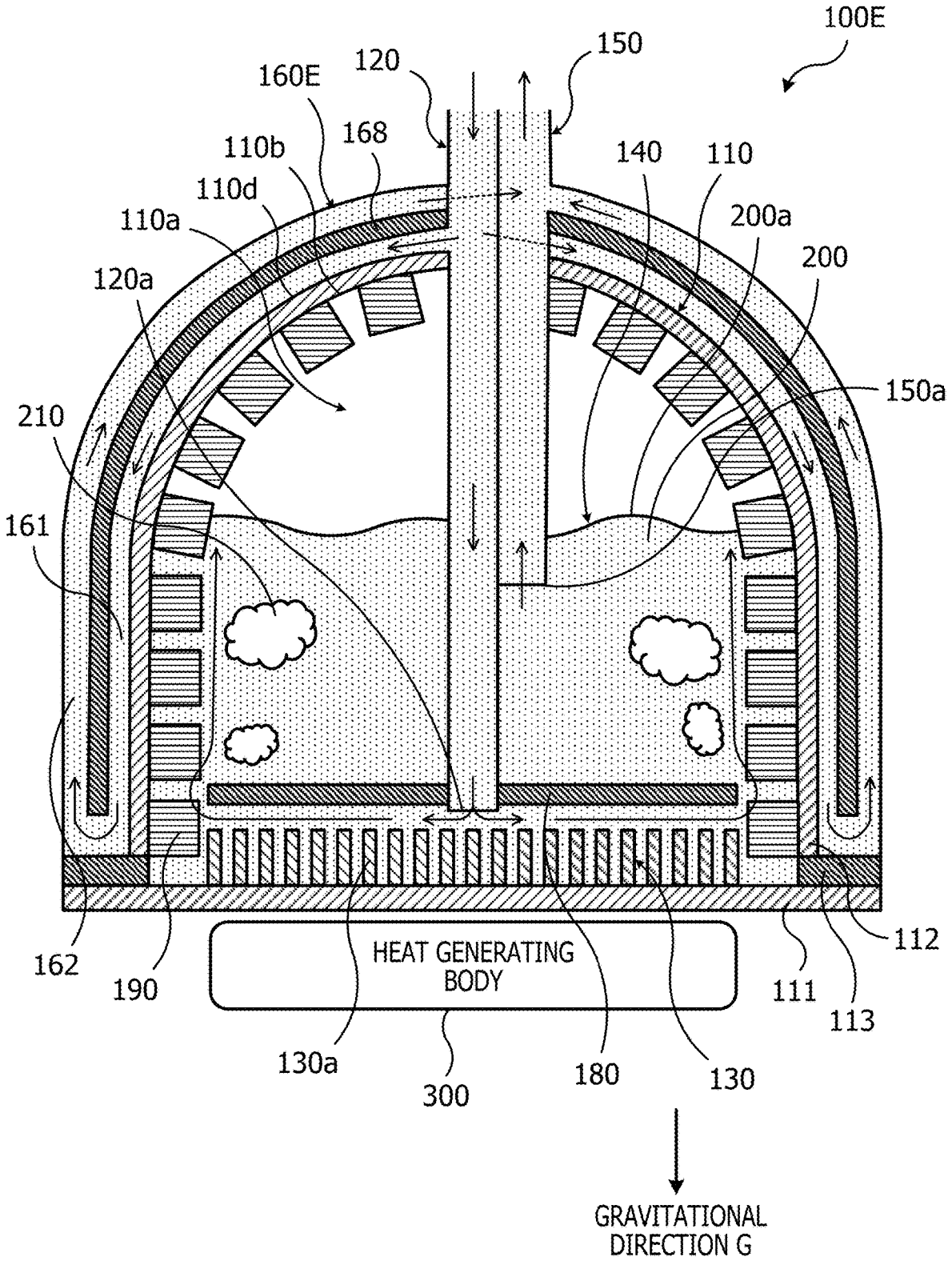
FIG. 15 is a diagram of assistance in explaining an example of an evaporator according to a sixth embodiment.

FIG. 15 is a diagram of assistance in explaining an example of an evaporator according to a sixth embodiment. FIG. 15 schematically illustrates a fragmentary sectional view of the example of the evaporator.

An evaporator 100E illustrated in FIG. 15 includes a supplying unit 160E having an inside flow passage 161, an outside flow passage 162, and a heat insulating layer 168 interposed between the inside flow passage 161 and the outside flow passage 162. The evaporator 100E is different from the evaporator 100A (FIGS. 4 to 8) described in the foregoing second embodiment in such a respect.

A liquid phase refrigerant 200 supplied to the supplying unit 160E is increased in temperature by heat exchange with an inner part 110*a* while circulated through the inside flow passage 161 from an upper portion to a lower portion of a container 110. The liquid phase refrigerant 200 circulated through the inside flow passage 161 is further increased in temperature by heat exchange with the inner part 110*a* and the inside flow passage 161 while returned and circulated through the outside flow passage 162 from the lower portion to the upper portion of the container 110. The interposition of the heat insulating layer 168 between the inside flow passage 161 and the outside flow passage 162 as in the evaporator 100E suppresses heat exchange between the outside flow passage 162 and the inside flow passage 161 and heat exchange between the outside flow passage 162 and the inner part 110*a*. Consequently, an increase in the temperature of the liquid phase refrigerant 200 circulated through the outside flow passage 162 is suppressed, and an increase in the temperature of the liquid phase refrigerant 200 circulated through the inside flow passage 161 is thereby suppressed. The liquid phase refrigerant 200 whose temperature increase is thus suppressed flows into the outside flow passage 162. According to the evaporator 100E, an increase in the temperature of the liquid phase refrigerant 200 circulated through the supplying unit 160E is suppressed. In the evaporator 100E, the temperature of the liquid phase refrigerant 200 fed to a radiator of a cooling system through a discharging unit 150, for example, is decreased, so that efficiency of heat radiation in the radiator is enhanced. In addition, in the evaporator 100E, the boiling of the liquid phase refrigerant 200 circulated through the supplying unit 160E and resulting generation of a gaseous phase refrigerant 210 are suppressed effectively.

The evaporator 100E, also, may suppress the amount of discharge of the gaseous phase refrigerant 210 to the outside while increasing the amount of generation of the gaseous phase refrigerant 210 due to heat absorption. Thus, stable pump circulation may be realized while a high cooling capacity of the evaporator 100E is realized.

Incidentally, a method of interposing the heat insulating layer 168 between the inside flow passage 161 and the outside flow passage 162 of the supplying unit 160E as in the evaporator 100E may be similarly applied also to the evaporator 100B (FIGS. 10 to 12) described in the foregoing third embodiment. In addition, the method of thus interposing the heat insulating layer 168 between the inside flow passage 161 and the outside flow passage 162 may be similarly applied also to the evaporator 100D (FIG. 14) described in the foregoing fifth embodiment.

Seventh Embodiment

Figure 16:
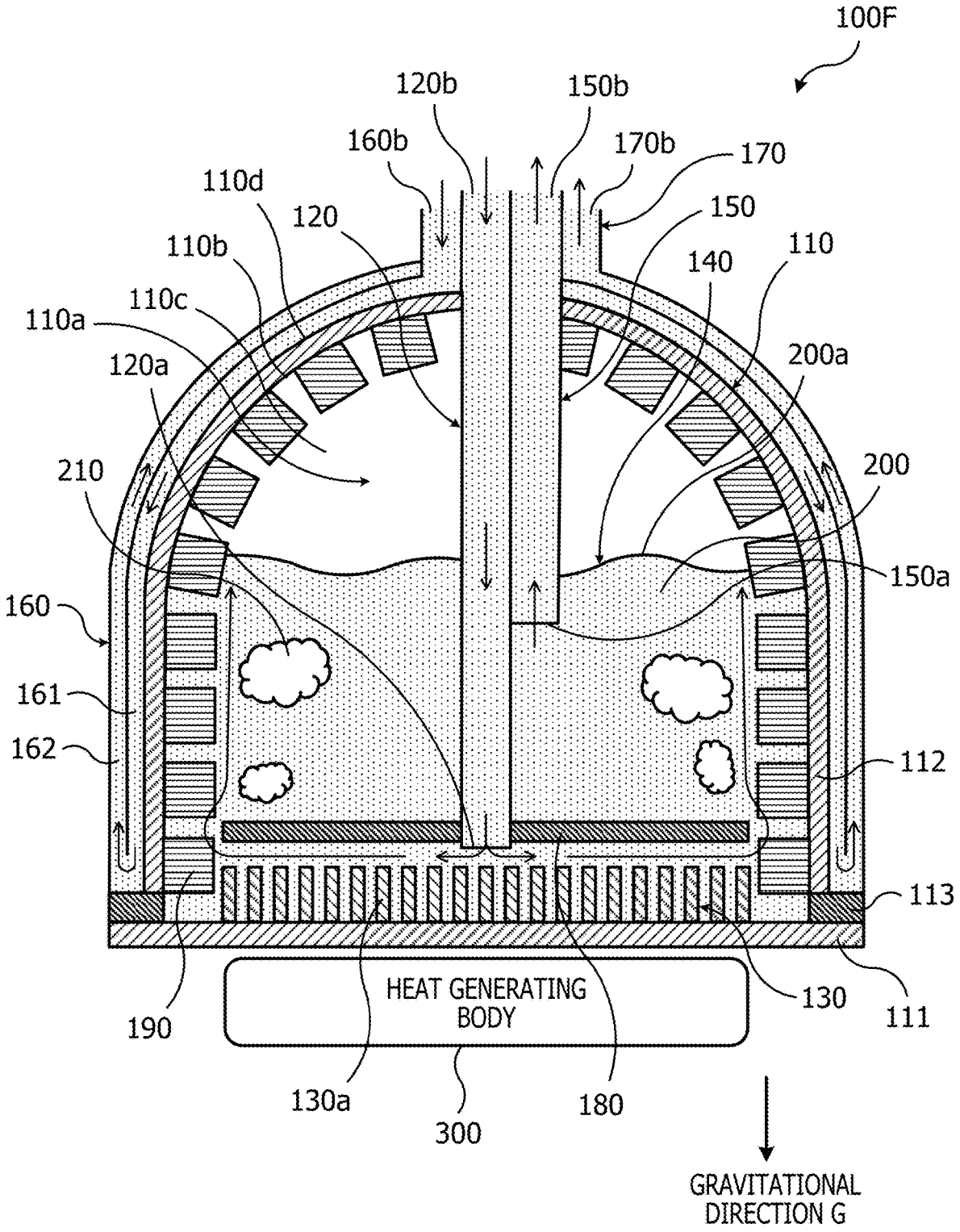
FIG. 16 is a diagram of assistance in explaining an example of an evaporator according to a seventh embodiment.

FIG. 16 is a diagram of assistance in explaining an example of an evaporator according to a seventh embodiment. FIG. 16 schematically illustrates a fragmentary sectional view of the example of the evaporator.

In an evaporator 100F illustrated in FIG. 16, an inlet 160*b* of a supplying unit 160 that supplies a liquid phase refrigerant 200 along an outer surface 110*d* of a container 110 is provided so as to be separated from an inlet 120*b* of a supplying unit 120 that supplies the liquid phase refrigerant 200 to an inner part 110*a* of the container 110. In the evaporator 100F, further, an outlet 170*b* of a discharging unit 170 that discharges the liquid phase refrigerant 200 supplied along the outer surface 110*d* of the container 110 is provided so as to be separated from an outlet 150*b* of a discharging unit 150 that discharges the liquid phase refrigerant 200 in the inner part 110*a* of the container 110. The evaporator 100F is different from the evaporator 100A (FIGS. 4 to 8) described in the foregoing second embodiment in such a respect.

In the evaporator 100F, two pipes extending from a pump coupled to a radiator of a cooling system or two pipes branched from one pipe extending from the pump are, for example, coupled to the inlet 160*b* of the supplying unit 160 and the inlet 120*b* of the supplying unit 120, respectively. In addition, in the evaporator 100F, pipes are, for example, coupled to the outlet 170*b* of the discharging unit 170 and the outlet 150*b* of the discharging unit 150, respectively. The two pipes are each extended to the radiator and coupled to the radiator. Alternatively, the two pipes are coupled to one pipe in front of the radiator, and the one pipe is coupled to the radiator.

The configuration of the inlets and outlets, branching point, and merging point of the liquid phase refrigerant is not limited as long as the liquid phase refrigerant 200 may be supplied to the outer surface 110*d* and the inner part 110*a* of the container 110 and the liquid phase refrigerant 200 may be discharged from the outer surface 110*d* and the inner part 110*a* of the container 110.

Incidentally, a method of providing the inlets 120*b* and 160*b* of the supplying units 120 and 160 and the outlets 150*b* and 170*b* of the discharging units 150 and 170 as in the evaporator 100F may be similarly applied also to the evaporator 100B (FIGS. 10 to 12) described in the foregoing third embodiment. In addition, such a method may be similarly applied also to the evaporator 100D (FIG. 14) and the evaporator 100E (FIG. 15) described in the foregoing fifth and sixth embodiments.

Eighth Embodiment

Figure 17:
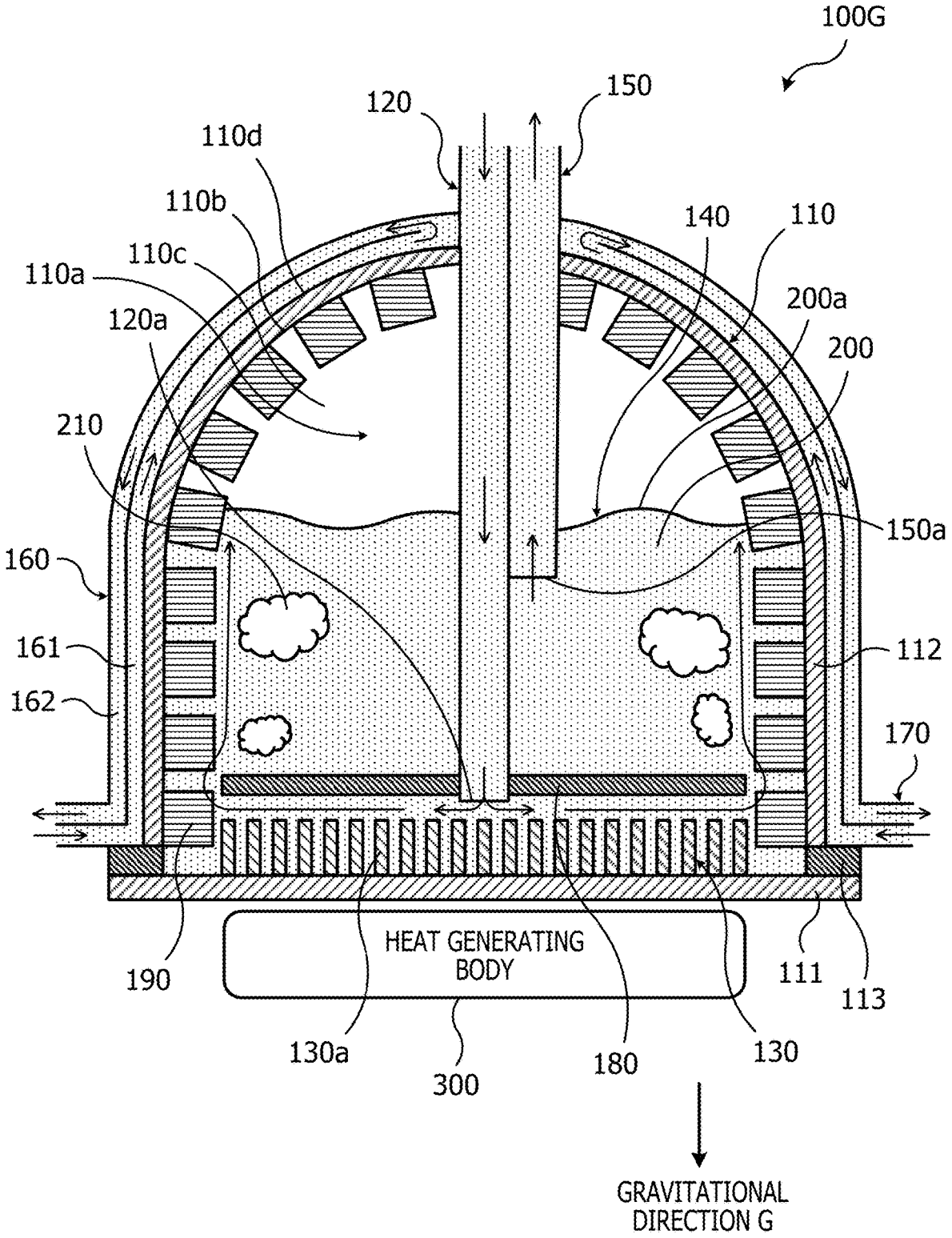
FIG. 17 is a diagram of assistance in explaining an example of an evaporator according to an eighth embodiment.

FIG. 17 is a diagram of assistance in explaining an example of an evaporator according to an eighth embodiment. FIG. 17 schematically illustrates a fragmentary sectional view of the example of the evaporator.

In an evaporator 100G illustrated in FIG. 17, a liquid phase refrigerant 200 supplied along an outer surface 110*d* of a container 110 is circulated through an inside flow passage 161 from a lower portion to an upper portion of the container 110, and is returned and circulated through an outside flow passage 162 from the upper portion to the lower portion. The liquid phase refrigerant 200 circulated through the flow passage 162 is discharged from a discharging unit 170. The evaporator 100G is different from the evaporator 100A described in the foregoing second embodiment in such a respect.

A heat absorbing unit 130 in which the liquid phase refrigerant 200 absorbs heat from an external heat generating body 300 is provided to the lower portion of the container 110 (lower layer portion of the liquid phase refrigerant 200 in a storage part 140). Therefore, the lower layer portion of the liquid phase refrigerant 200 in the storage part 140, the heat absorbing unit 130 being disposed in the lower layer portion, is raised in temperature easily and boils easily as compared with an upper layer portion of the liquid phase refrigerant 200 on a space 110*c* side. That is, a gaseous phase refrigerant 210 occurs easily in the lower layer portion of the liquid phase refrigerant 200 stored in the storage part 140.

In the evaporator 100G, the liquid phase refrigerant 200 is circulated through the inside flow passage 161 of a supplying unit 160 along the outer surface 110*d* from the lower portion to the upper portion of the container 110. While thus circulated from the lower portion to the upper portion, the liquid phase refrigerant 200 is made to exchange heat with an inner part 110*a*, and is consequently increased in temperature. Therefore, in the evaporator 100G, the closer a part of the outer surface 110*d* is to the lower layer portion of the liquid phase refrigerant 200 in the storage part 140, the gaseous phase refrigerant 210 occurring easily in the lower layer portion of the liquid phase refrigerant 200, the lower the temperature of the liquid phase refrigerant 200 circulated along the part becomes. The evaporator 100G may thereby quickly condense the gaseous phase refrigerant 210 generated by heat absorption in the heat absorbing unit 130 (for example, condense the gaseous phase refrigerant 210 in the liquid phase refrigerant 200), and thus return the gaseous phase refrigerant 210 to the liquid phase refrigerant 200.

The evaporator 100G, also, may suppress the amount of discharge of the gaseous phase refrigerant 210 to the outside while increasing the amount of generation of the gaseous phase refrigerant 210 due to heat absorption. Thus, stable pump circulation may be realized while a high cooling capacity of the evaporator 100G is realized.

Incidentally, a method of circulating the liquid phase refrigerant 200 along the outer surface 110*d* from the lower portion to the upper portion of the container 110 as in the evaporator 100G may be similarly applied also to the evaporator 100B (FIGS. 10 to 12) described in the foregoing third embodiment. In addition, such a method may be similarly applied also to the evaporator 100D (FIG. 14) and the evaporator 100E (FIG. 15) described in the foregoing fifth and sixth embodiments.

Ninth Embodiment

Figure 18:
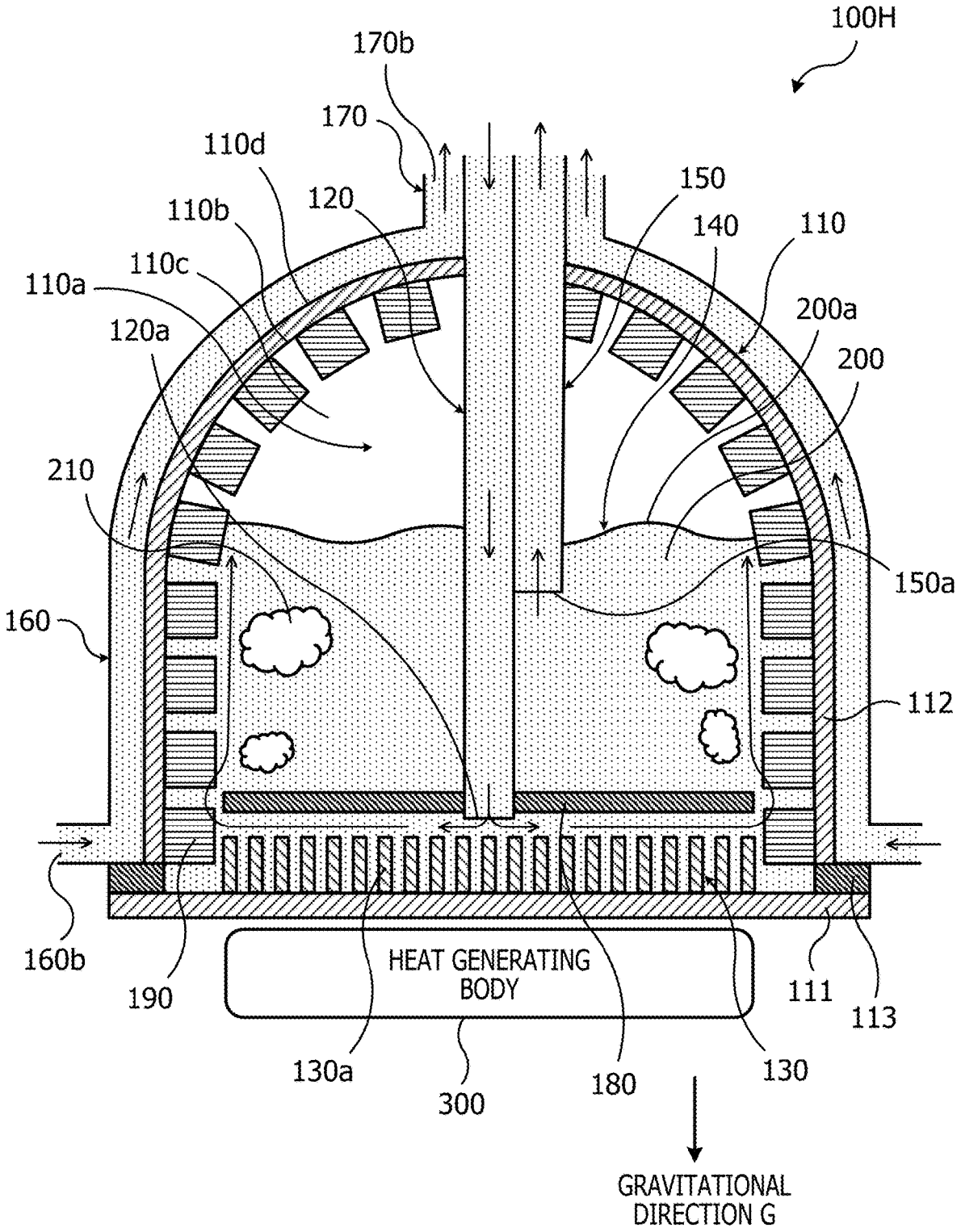
FIG. 18 is a diagram of assistance in explaining an example of an evaporator according to a ninth embodiment.

FIG. 18 is a diagram of assistance in explaining an example of an evaporator according to a ninth embodiment. FIG. 18 schematically illustrates a fragmentary sectional view of the example of the evaporator.

In an evaporator 100H illustrated in FIG. 18, an inlet 160*b* of a supplying unit 160 that supplies a liquid phase refrigerant 200 along an outer surface 110*d* of a container 110 is provided to a lower portion of the container 110, and an outlet 170*b* of a discharging unit 170 that discharges the liquid phase refrigerant 200 is provided to an upper portion of the container 110. In the evaporator 100H, the liquid phase refrigerant 200 is supplied from the lower portion of the container 110, circulated toward the upper portion, and discharged from the upper portion of the container 110. The evaporator 100H is different from the evaporator 100A described in the foregoing second embodiment in such a respect.

A heat absorbing unit 130 in which the liquid phase refrigerant 200 absorbs heat from an external heat generating body 300 is provided to the lower portion of the container 110 (lower layer portion of the liquid phase refrigerant 200 in the storage part 140). Therefore, the lower layer portion of the liquid phase refrigerant 200 in the storage part 140, the heat absorbing unit 130 being disposed in the lower layer portion, is raised in temperature easily and boils easily as compared with the upper layer portion of the liquid phase refrigerant 200 on the space 110*c* side. That is, the gaseous phase refrigerant 210 occurs easily in the lower layer portion of the liquid phase refrigerant 200 stored in the storage part 140.

In the evaporator 100H, the supplying unit 160 circulates the liquid phase refrigerant 200 along the outer surface 110*d* from the lower portion to the upper portion of the container 110. While thus circulated from the lower portion to the upper portion, the liquid phase refrigerant 200 is made to exchange heat with the inner part 110*a*, and is consequently increased in temperature. Therefore, in the evaporator 100H, the closer a part of the outer surface 110*d* is to the lower layer portion of the liquid phase refrigerant 200 in the storage part 140, the gaseous phase refrigerant 210 occurring easily in the lower layer portion of the liquid phase refrigerant 200, the lower the temperature of the liquid phase refrigerant 200 circulated along the part becomes. The evaporator 100H may thereby quickly condense the gaseous phase refrigerant 210 generated by heat absorption in the heat absorbing unit 130 (for example condense the gaseous phase refrigerant 210 in the liquid phase refrigerant 200), and thus return the gaseous phase refrigerant 210 to the liquid phase refrigerant 200.

Further, in the evaporator 100H, the liquid phase refrigerant 200 circulated along the outer surface 110*d* from the lower portion to the upper portion of the container 110 is directly discharged from the upper portion of the container 110 through the discharging unit 170 without being returned. Therefore, the liquid phase refrigerant 200 increased in temperature by heat exchange with the inner part 110*a* while circulated from the lower portion to the upper portion of the container 110 is not involved in an increase in the temperature of the following liquid phase refrigerant 200 circulated later. The liquid phase refrigerant 200 circulated along the outer surface 110*d* from the lower portion to the upper portion of the container 110 may cool the inside of the container 110, and condense the gaseous phase refrigerant 210 efficiently.

The evaporator 100H, also, may suppress the amount of discharge of the gaseous phase refrigerant 210 to the outside while increasing the amount of generation of the gaseous phase refrigerant 210 due to heat absorption. Thus, stable pump circulation may be realized while a high cooling capacity of the evaporator 100H is realized.

Incidentally, a method of circulating the liquid phase refrigerant 200 along the outer surface 110*d* from the lower portion to the upper portion of the container 110 as in the evaporator 100H may be similarly applied also to the evaporator 100B (FIGS. 10 to 12) described in the foregoing third embodiment. In addition, such a method may be similarly applied also to the evaporator 100D (FIG. 14) and the evaporator 100E (FIG. 15) described in the foregoing fifth and sixth embodiments.

Tenth Embodiment

The evaporators 10A, 10B, 100A, 100B, 100C, 100D, 100E, 100F, 100G, and 100H described in the foregoing first to ninth embodiments and the like may be used in a cooling system.

Figure 19:
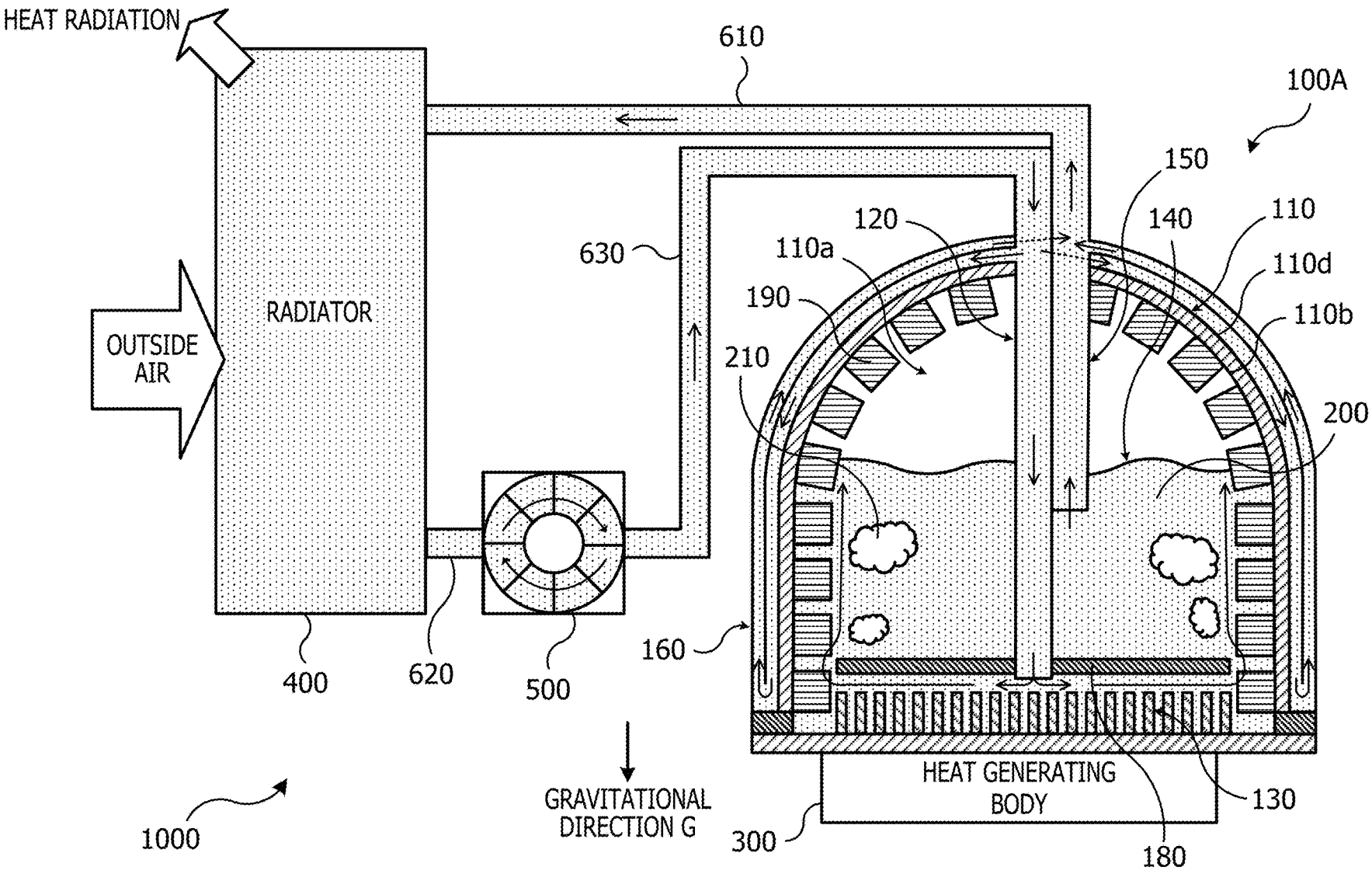
FIG. 19 is a diagram of assistance in explaining an example of a cooling system according to a tenth embodiment.

FIG. 19 is a diagram of assistance in explaining an example of a cooling system according to a tenth embodiment.

FIG. 19 illustrates, as an example, a cooling system 1000 using the evaporator 100A as described in the foregoing second embodiment. The cooling system 1000 illustrated in FIG. 19 includes the evaporator 100A, a radiator 400, and a pump 500. The evaporator 100A and the radiator 400 are coupled to each other by a pipe 610. The radiator 400 and the pump 500 are coupled to each other by a pipe 620. The pump 500 and the evaporator 100A are coupled to each other by a pipe 630. The evaporator 100A, the radiator 400, and the pump 500 as well as the pipe 610, the pipe 620, and the pipe 630 form a closed circuit of the cooling system 1000. A liquid phase refrigerant 200 is filled in a decompressed state into the closed circuit of such a cooling system 1000.

The evaporator 100A is thermally coupled directly or indirectly to an external heat generating body 300 such as an electronic device or the like to be cooled by the cooling system 1000. The evaporator 100A absorbs heat transmitted from the heat generating body 300 by using the vaporization phenomenon of the internal liquid phase refrigerant 200, and thereby cools the heat generating body 300. Through the pipe 610, the radiator 400 takes in the liquid phase refrigerant 200 discharged from the evaporator 100A or the liquid phase refrigerant 200 including a gaseous phase refrigerant 210. The radiator 400 radiates the heat of the taken-in liquid phase refrigerant 200 or the liquid phase refrigerant 200 including the gaseous phase refrigerant 210 to the outside by using outside air, and thereby lowers the temperature of the liquid phase refrigerant 200. When the gaseous phase refrigerant 210 is included, the radiator 400 condenses the gaseous phase refrigerant 210 and lowers the temperature of the liquid phase refrigerant 200. The pump 500 takes in the liquid phase refrigerant 200 condensed or lowered in temperature by the radiator 400 through the pipe 620, and feeds the liquid phase refrigerant 200 to the evaporator 100A through the pipe 630. The evaporator 100A absorbs heat from the heat generating body 300 (cools the heat generating body 300) by using the liquid phase refrigerant 200 fed from the pump 500 through the pipe 630. The cooling system 1000 is an example of a circulation type cooling system that thus utilizes the vaporization phenomenon of the liquid phase refrigerant 200.

In the evaporator 100A, as described above, the liquid phase refrigerant 200 at a relatively low temperature, the liquid phase refrigerant 200 being fed from the pump 500 coupled to the radiator 400, is supplied to the inner part 110*a* of the container 110 by the supplying unit 120, and stored in the storage part 140. The liquid phase refrigerant 200 in the storage part 140 absorbs the heat of the heat generating body 300 in the heat absorbing unit 130. The liquid phase refrigerant 200 including the gaseous phase refrigerant 210 generated by the boiling of the liquid phase refrigerant 200 due to the heat absorption moves toward the inner surface 110*b* of the container 110 while guided by the guide 180, and further moves upward along the inner surface 110*b*. In the evaporator 100A, the supplying unit 160 circulates the liquid phase refrigerant 200 at a relatively low temperature along the outer surface 110*d* of the container 110. Thus, the container 110 and the fin 190 are cooled, and the generated gaseous phase refrigerant 210 is cooled and condensed within the evaporator 100A and stored in the storage part 140. Incidentally, not all of the generated gaseous phase refrigerant 210 necessarily needs to be condensed. The liquid phase refrigerant 200 or the liquid phase refrigerant 200 including the gaseous phase refrigerant 210 in the storage part 140 is discharged to the outside of the evaporator 100A through the discharging unit 150, and fed to the radiator 400 through the pipe 610. Then, the liquid phase refrigerant 200 condensed and lowered in temperature by the heat radiation of the radiator 400 is taken into the pump 500 through the pipe 620, and fed to the supplying unit 120 and the supplying unit 160 of the evaporator 100A again from the pump 500 through the pipe 630.

In the evaporator 100A, the amount of discharge of the gaseous phase refrigerant 210 is suppressed by the function of condensing the gaseous phase refrigerant 210 by using the liquid phase refrigerant 200 supplied along the outer surface 110*d* of the container 110 by the supplying unit 160. The occurrence of biting of the gaseous phase refrigerant 210 by the pump 500 is thereby suppressed, so that the pump 500 circulates the liquid phase refrigerant 200 stably. Further, because the liquid phase refrigerant 200 is thus circulated stably, a condition under which the boiling of the liquid phase refrigerant 200 occurs easily may be used, and the cooling capacity of the evaporator 100A is thereby enhanced. The cooling system 1000 is realized which includes the evaporator 100A having a high cooling capacity and in which the pump 500 circulates the liquid phase refrigerant 200 stably.

The cooling system 1000 using the evaporator 100A as described in the foregoing second embodiment has been illustrated here. In addition, cooling systems are similarly realized which use the evaporators 10A, 10B, 100B, 100C, 100D, 100E, 100F, 100G, and 100H as described in the foregoing first and third to ninth embodiments and the like.

Eleventh Embodiment

The cooling system 1000 as described in the foregoing tenth embodiment and the like may be applied to an electronic apparatus.

Figure 20:
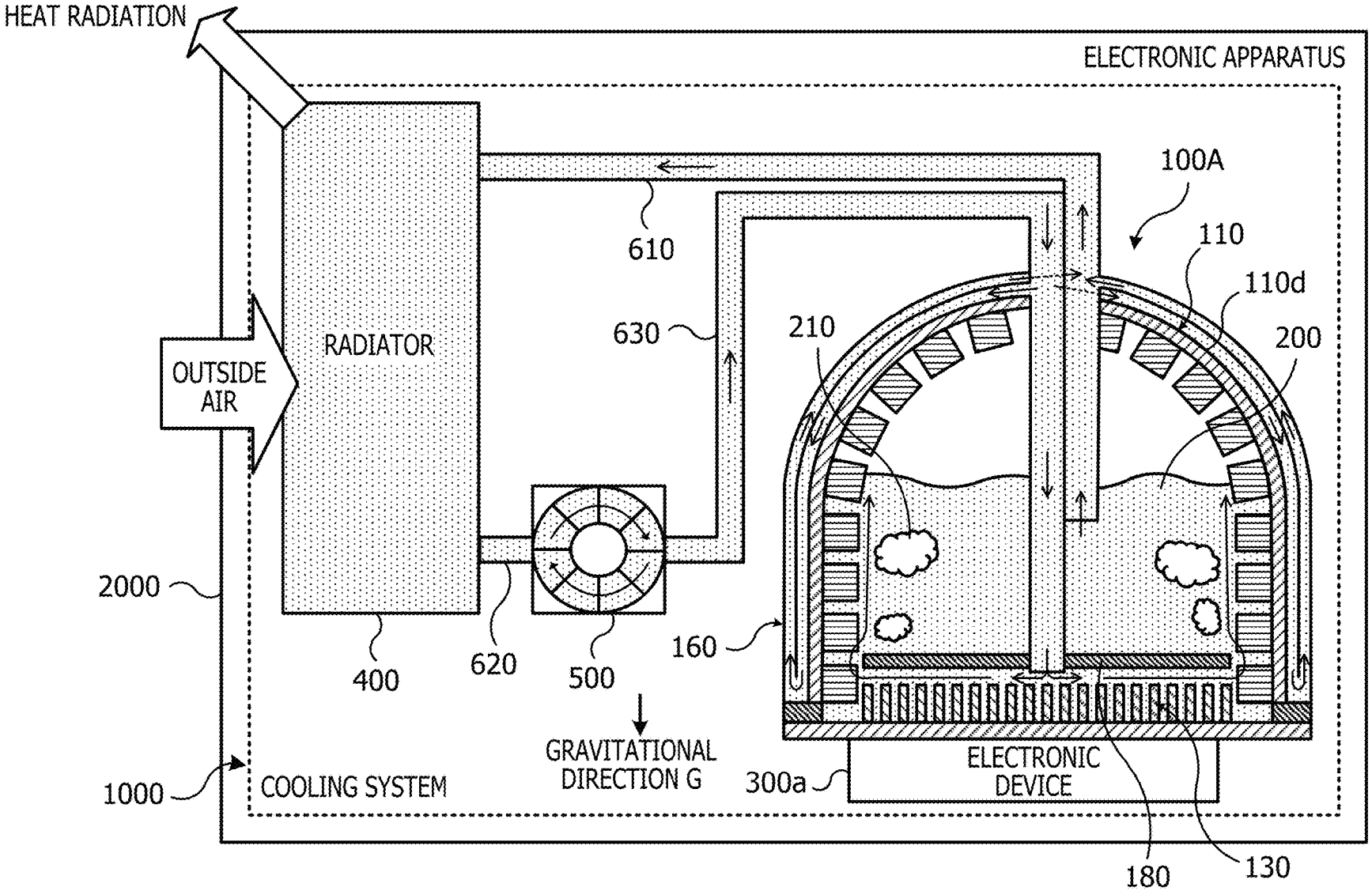
FIG. 20 is a diagram of assistance in explaining an example of an electronic apparatus according to an eleventh embodiment.

FIG. 20 is a diagram of assistance in explaining an example of an electronic apparatus according to an eleventh embodiment.

FIG. 20 illustrates, as an example, an electronic apparatus 2000 using the cooling system 1000 as described in the foregoing tenth embodiment. The electronic apparatus 2000 illustrated in FIG. 20 includes the cooling system 1000 and an electronic device 300*a* that is a heat generating body to be cooled by the cooling system 1000 and is thermally coupled to the cooling system 1000. The cooling system 1000 and the electronic device 300*a* thus thermally coupled to each other are, for example, incorporated into (built into) a casing of the electronic apparatus 2000. Alternatively, the cooling system 1000 and the electronic device 300*a* thermally coupled to each other are incorporated in a slot, rack, or the like of the electronic apparatus 2000.

In the evaporator 100A used in the cooling system 1000, the amount of discharge of the gaseous phase refrigerant 210 is suppressed by the function of condensing the gaseous phase refrigerant 210 by using the liquid phase refrigerant 200 supplied along the outer surface 110*d* of the container 110 by the supplying unit 160. The occurrence of biting of the gaseous phase refrigerant 210 by the pump 500 is thereby suppressed, so that the pump 500 circulates the liquid phase refrigerant 200 stably. Further, because the liquid phase refrigerant 200 is thus circulated stably, a condition under which the boiling of the liquid phase refrigerant 200 occurs easily may be used, and the cooling capacity of the evaporator 100A is thereby enhanced. The cooling system 1000 is realized which includes the evaporator 100A having a high cooling capacity and in which the pump 500 circulates the liquid phase refrigerant 200 stably. In the electronic apparatus 2000, because such a cooling system 1000 is used, the electronic device 300*a* is cooled efficiently and stably, and overheating of the electronic device 300*a* and damage and performance degradation in the electronic device 300*a* due to the overheating are suppressed. The electronic apparatus 2000 excellent in performance and reliability is thereby realized.

The electronic apparatus 2000 using the cooling system 1000 as described in the foregoing tenth embodiment has been illustrated here. In addition, electronic apparatuses are similarly realized in which cooling systems using the evaporators 10A, 10B, 100B, 100C, 100D, 100E, 100F, 100G, and 100H as described in the foregoing first and third to ninth embodiments and the like are thermally coupled to the electronic device 300*a*.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An evaporator comprising:

a container;

a first supplying unit configured to supply a liquid phase refrigerant to an inside of the container, the first supplying unit including a pipe and an outlet located in the inside of the container, the pipe extending from an upper portion to a lower portion of the container;

a second supplying unit disposed on a first part of an outer surface of the container along the outer surface of the container, the second supplying unit including a conduit for conveying the liquid phase refrigerant along the outer surface of the container, the second supplying unit being configured to supply the liquid phase refrigerant along the outer surface of the container to exchange first heat with an inner part of the container via the outer surface of the container;

a heat absorbing unit disposed on a second part of an inner surface of the container other than the first part, the heat absorbing unit being configured to be thermally coupled to a heat generating body located outside of the container and thereby to cause the liquid phase refrigerant supplied from the first supplying unit and located in the lower portion of the container to absorb second heat through the heat absorbing unit, the second heat being supplied from the heat generating body via the second part of the outer surface of the container, the second part being a part of the container other than the first part;

a storage part disposed on the inside of the container, the storage part being configured to store the liquid phase refrigerant absorbing the heat in the heat absorbing unit, and store the liquid phase refrigerant obtained by cooling and condensing a gaseous phase refrigerant by the exchanging of the first heat between the liquid phase refrigerant supplied to the conduit of the second supplying unit, the gaseous phase refrigerant being a refrigerant evaporated by the absorbing of the second heat in the heat absorbing unit; and a discharging unit configured to discharge the liquid phase refrigerant stored in the storage part, the discharging unit extending from the upper portion to the lower portion of the container and including an inlet located in the inside of the container, the outlet of the first supplying unit is located at a first position, the inlet of the discharging unit is located at a second position, the first position is a position closer to the heat absorbing unit than the second position in order to continuously supply the liquid phase refrigerant at relatively low temperature from the outlet of the first supplying unit to the heat absorbing unit, and the second position is a position closer to a center of an inner space of the storage part than the first position in order to make the inlet of the discharging unit to be located below a liquid surface of the liquid phase refrigerant in the storage part even when the evaporator is turned over.

2. The evaporator according to claim 1, wherein a liquid phase refrigerant outlet of the first supplying unit reaches the heat absorbing unit or is located in a vicinity of the heat absorbing unit.

3. The evaporator according to claim 2, wherein a liquid phase refrigerant inlet of the discharging unit is located below a liquid surface of the liquid phase refrigerant stored in the storage part.

4. The evaporator according to a claim 3, further comprising a first fin disposed on an inner surface of the container, and thermally coupled to the liquid phase refrigerant supplied along the outer surface by the second supplying unit.

5. The evaporator according to claim 4, wherein the liquid phase refrigerant supplied along the outer surface by the second supplying unit is distributed from one position of the surface to a periphery of the one position, and circulated along the outer surface.

6. The evaporator according to claim 5, wherein the second supplying unit includes a first flow passage disposed along the outer surface, the first flow passage circulating the liquid phase refrigerant along the outer surface, and a second flow passage folded back from the first flow passage and disposed on an outside of the first flow passage, the second flow passage circulating the liquid phase refrigerant circulated through the first flow passage along the outside of the first flow passage.

7. The evaporator according to claim 6, wherein the second supplying unit further includes a heat insulating layer interposed between the first flow passage and the second flow passage.

8. The evaporator according to claim 7, wherein the container includes a thermally conductive bottom plate, a thermally conductive container main body covering the bottom plate, and a heat insulative coupling portion interposed between the bottom plate and the container main body, the coupling portion coupling the bottom plate and the container main body to each other.

9. A cooling system comprising:

an evaporator in which a supplied liquid phase refrigerant absorbs heat from an outside and evaporates;

a radiator configured to radiate the heat of the liquid phase refrigerant discharged from the evaporator; and a pump configured to supply, to the evaporator, the liquid phase refrigerant cooled by being subjected to heat radiation by the radiator, wherein the evaporator including a container, a first supplying unit that supplies the liquid phase refrigerant to an inside of the container, the first supplying unit including a pipe and an outlet located in the inside of the container, the pipe extending from an upper portion to a lower portion of the container, a second supplying unit disposed on a first part of an outer surface of the container along the outer surface of the container, the second supplying unit including a conduit for conveying the liquid phase refrigerant along the outer surface of the container, the second supplying unit being configured to supply the liquid phase refrigerant along the outer surface of the container to exchange first heat with an inner part of the container via the outer surface of the container, a heat absorbing unit disposed on a second part of an inner surface of the container other than the first part, the heat absorbing unit being configured to be thermally coupled to a heat generating body located outside of the container and thereby to cause the liquid phase refrigerant supplied from the first supplying unit and located in the lower portion of the container to absorb second heat through the heat absorbing unit, the second heat being supplied from the heat generating body via the second part of the outer surface of the container, the second part being a part of the container other than the first part, a storage part disposed on the inside of the container, the storage part being configured to store the liquid phase refrigerant absorbing the heat in the heat absorbing unit, and store the liquid phase refrigerant obtained by cooling and condensing a gaseous phase refrigerant by the exchanging of the first heat between the liquid phase refrigerant supplied to the conduit of the second supplying unit, the gaseous phase refrigerant being a refrigerant evaporated by the absorbing of the second heat in the heat absorbing unit, and a discharging unit that discharges the liquid phase refrigerant stored in the storage part, the discharging unit extending from the upper portion to the lower portion of the container and including an inlet located in the inside of the container, the outlet of the first supplying unit is located at a first position, the inlet of the discharging unit is located at a second position, the first position is a position closer to the heat absorbing unit than the second position in order to continuously supply the liquid phase refrigerant at relatively low temperature from the outlet of the first supplying unit to the heat absorbing unit, and the second position is a position closer to a center of an inner space of the storage part than the first position in order to make the inlet of the discharging unit to be located below a liquid surface of the liquid phase refrigerant in the storage part even when the evaporator is turned over.

* * * * *